US006688929B2

(12) United States Patent
Lecours et al.

(10) Patent No.: US 6,688,929 B2
(45) Date of Patent: Feb. 10, 2004

(54) PERSONAL WATERCRAFT HAVING AN IMPROVED EXHAUST SYSTEM

(75) Inventors: Gaétan Lecours, Valcourt (CA); Éric Ménard, Rock Forest (CA); Robert Lachance, Valcourt (CA); Thomas Perron, Magog (CA); Jeff Oler, Palm Bay, FL (US)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 10/368,448

(22) Filed: Feb. 20, 2003

(65) Prior Publication Data

US 2003/0129892 A1 Jul. 10, 2003

Related U.S. Application Data

(62) Division of application No. 09/886,464, filed on Jun. 22, 2001, now Pat. No. 6,551,155.

(60) Provisional application No. 60/213,242, filed on Jun. 22, 2000, and provisional application No. 60/242,063, filed on Oct. 23, 2000.

(51) Int. Cl.[7] ..... B63H 21/32

(52) U.S. Cl. ..... 440/89 R; 440/88 R

(58) Field of Search ..... 440/88 R, 89 R

(56) References Cited

U.S. PATENT DOCUMENTS

| | | | |
|---|---|---|---|
| 4,393,956 | A | 7/1983 | Tsukui et al. |
| 4,781,021 | A | 11/1988 | Winberg |
| 4,811,560 | A | 3/1989 | Nakase et al. |
| 5,234,364 | A | 8/1993 | Ito |
| 5,324,217 | A | 6/1994 | Mineo |
| 5,390,621 | A | 2/1995 | Hattori et al. |
| 5,531,620 | A | 7/1996 | Ozawa et al. |
| 5,536,189 | A | 7/1996 | Mineo |
| 5,550,337 | A | 8/1996 | Tazaki et al. |
| 5,572,943 | A | 11/1996 | Kobayashi et al. |
| 5,619,950 | A | 4/1997 | Ikeda |
| 5,634,422 | A | 6/1997 | Kobayashi et al. |
| 5,647,779 | A | 7/1997 | Nanami |
| 5,664,515 | A | 9/1997 | Hattori et al. |
| 5,669,326 | A | 9/1997 | Ikeda |
| 5,699,749 | A | 12/1997 | Yamada et al. |
| 5,752,867 | A | 5/1998 | Koyanagi |

(List continued on next page.)

FOREIGN PATENT DOCUMENTS

| | | |
|---|---|---|
| WO | WO 99/36685 | 7/1999 |

OTHER PUBLICATIONS

Bombardier "Sea–Doo," Parts Catalog GS 5846/5847, 1999, p. A2, A11 & A12.

Bombardier "Sea–Doo," Parts Catalog GSX Ltd. 5848/5849, 1999, p. A2, A12 & B1.

(List continued on next page.)

*Primary Examiner*—Jesus D. Sotelo
(74) *Attorney, Agent, or Firm*—Pillsbury Winthrop LLP

(57) ABSTRACT

A personal watercraft with an exhaust system including a first and second mufflers each disposed in opposite sides of the hull. A manifold pipe communicates the engine with the first muffler. A transfer pipe communicates the first muffler with the second muffler. An outlet pipe communicates the second muffler to the atmosphere at an exhaust point located at an opposite side of the hull. The outlet pipe has a raised portion between the second muffler and the exhaust point so that only rotation of the watercraft in a first rotational direction will cause entrant water in the outlet pipe to flow into the second muffler. The transfer pipe has a raised portion between the first and second mufflers so that only rotation of the watercraft in second rotational direction about the longitudinal axis opposite the first rotational direction will cause water that has flowed into the second muffler to flow into the first muffler.

24 Claims, 19 Drawing Sheets

U.S. PATENT DOCUMENTS

| | | | | | |
|---|---|---|---|---|---|
| 5,820,426 | A | | 10/1998 | Hale | |
| 5,902,158 | A | | 5/1999 | Nakase et al. | |
| 5,902,161 | A | | 5/1999 | Nakase | |
| 5,928,044 | A | | 7/1999 | Mineo | |
| 5,967,565 | A | | 10/1999 | Kim | |
| 6,022,253 | A | | 2/2000 | Ozawa et al. | |
| 6,086,110 | A | * | 7/2000 | Lee et al. | 285/49 |
| 6,164,703 | A | | 12/2000 | Kim | |
| 6,183,324 | B1 | | 2/2001 | Nanami | |

OTHER PUBLICATIONS

Bombardier "Sea–Doo," Parts Catalog GSX RFI 5637/5638/5652/5829, 1999, p. A2, B1 & B2.

Bombardier "Sea–Doo," Parts Catalog GTX Ltd. 5888/5889, 1999, p. A2, B1 & B2.

Bombardier "Sea–Doo," Parts Catalog GTX RFI 5886/5887, 1999, p. A2, B2 & B2.

Bombardier "Sea–Doo," Parts Catalog SPX 5636/5828, 1999, p. A2, A12 & B1.

Bombardier "Sea–Doo," Parts Catalog XP Ltd. 5868/5869, 1999, p. A2, A12 & B1.

Bombardier "Sea–Doo," Parts Catalog GTX DI 5649/5659, 2000, p. A11 & A12.

Bombardier "Sea–Doo," Parts Catalog 5801, 1988, p. A5 & A6.

Bombardier "Sea–Doo," Parts Catalog 5802, 1989, p. A5, A6 & A7.

Bombardier "Sea–Doo," Parts Catalog 5804–5850, 1991, p. 5, 6 &7.

Bombardier "Sea–Doo," Parts Catalog HX 5880, p. A11 & A12.

Bombardier "Sea–Doo," Parts Catalog XP 5857, 1995, p. A11 & A12.

Bombardier "Sea–Doo," Parts Catalog XP 800/5856, 1995, p. A12 & B1.

* cited by examiner

PERSONAL WATERCRAFT HAVING AN IMPROVED EXHAUST SYSTEM

This is a Divisional Application of U.S. application Ser. No. 09/886,464 filed Jun. 22, 2001 U.S. Pat. No. 6,551,155, which claims priority to U.S. Provisional Application No. 60/213,242 filed Jun. 22, 2000, and U.S. Provisional Application No. 60/242,063 filed Oct. 23, 2000, the entirety of both applications are hereby incorporated into the present application by reference.

FIELD OF INVENTION

The present invention relates to a personal watercraft, and more specifically, to the exhaust system of a personal watercraft.

BACKGROUND OF THE INVENTION

Personal watercraft are typically constructed by attaching a deck shell to a hull shell to form an engine compartment therebetween. The propulsion systems for these personal watercraft normally include an inboard-mounted, internal combustion engine and a jet propulsion unit in the form of an impeller assembly positioned in a tunnel open to the underside and the stern of the hull. Because of the compact size of personal watercraft, limited space is available within the hull.

The compactness of personal watercraft presents a number of unique design problems. One such design problem is the layout of the exhaust system for discharging exhaust gases generated by the engine. This problem is rendered particularly acute because, as is typical with marine propulsion systems, the engine exhaust gases are typically discharged to the atmosphere either at, below or close to the water level depending on the speed of the watercraft. For example, at slow speeds the exhaust outlet may be below the waterline. At high speeds, the exhaust outlet will be located at a higher position and may be above the waterline. Because of this location of the exhaust outlet, care must be taken to ensure that water cannot enter the engine through the exhaust system. This problem is compounded because there is a possibility that the watercraft could capsize. Therefore, when capsized and subsequently righted, an adequate exhaust system design must ensure that any water that has entered the exhaust system will be prevented from finding its way into the engine. Additionally, even where the personal watercraft does not capsize, the exhaust system must be designed to inhibit coolant water that is directed into the mufflers via a water jacket from entering the engine. To prevent such occurrences, exhaust systems typically include exhaust pipe configurations designed to impede water flow toward the engine. This is typically accomplished by the combination of water traps, upwardly sloped exhaust pipes, and the use of mufflers, which also act as water traps in addition to providing sound attenuation of the exhaust gases. One such exhaust system design is disclosed in U.S. Pat. No. 5,699,749, the entirety of which is hereby incorporated into the present application by reference. The '749 patent utilizes two mufflers positioned on opposite sides of the watercraft, and which are connected by a U-shaped transfer pipe. An exhaust pipe extending from the second expansion chamber discharges the exhaust gases on the same side thereof and contiguous with the water level. With this design configuration, when the discharge end becomes submerged, water may enter the second muffler and becomes trapped therein. However, when the watercraft is capsized, in order to prevent the water in the second muffler from moving along the U-shaped transfer pipe to the first muffler, the watercraft must be uprighted by rotation about its longitudinal axis in only one direction. Rotation in the wrong direction will allow water to flow from the second muffler into the first muffler via the transfer pipe and thus increase the possibility of water entering the engine.

For example, viewing FIG. 4 of the '749 patent, rotation of the watercraft in a counterclockwise direction will prevent such flow because the inertia of the water tends to force against the muffler wall away from the inlet of the transfer pipe 49. However, rotation of the watercraft in a clockwise direction will cause water to flow by its own inertia from one muffler 52 along the U-shaped transfer pipe 49 to the other muffler 39. Once the water is in muffler 39, it is possible that the water can then flow towards and into the exhaust manifold of the engine if the watercraft is tilted at a forward pitch. If water is allowed to flow into the engine, it will flow into the piston chamber, which is designed for the combustion of a compressible charge. Because liquid water is incompressible, such water entering the combustion chamber creates water lock (also referred to as hydrolock) and renders the engine inoperable until the water is drained therefrom. In a worst case scenario, the engine may be permanently damaged, thereby requiring a replacement engine.

To impede water flow therethrough, mufflers may include internal chambers defined by partitioning walls, the internal chambers being interconnected to each other. The sequential expansion of the exhaust gases as it passes through each internal chamber also attenuates engine sound. However, the manufacture of mufflers with multiple internal chambers which must be interconnected is difficult.

Another design problem associated with vehicles powered by engines is the transmission of engine vibration to the exhaust system. Engine vibration is particularly severe when starting the engine. When the engine vibration is transmitted to the exhaust system, fatigue cracking of the exhaust system components and welded seams may occur rapidly, which can render the exhaust system in need of major repairs or replacement. To reduce the engine vibration to the exhaust system, flexible coupling devices are used between exhaust pipes. One such coupling device is disclosed in U.S. Pat. No. 5,967,565. The '565 patent discloses an exhaust pipe connected to an engine with a cover member installed about the exterior of the exhaust pipe. A guiding member extends from an end of the cover member to form two pockets on either side of the guiding member. A first pocket is formed between the guiding member and the rim of an inner retainer, and a second pocket is formed between the guiding member and an outer retainer. The first and second pockets contain elastic buffering members that absorb stress from the engine vibration. To protect the cover member from heat, a bellows is disposed between the inner retainer and the cover member. The bellows prevents leakage of exhaust gas and absorbs elastic and bending displacement experience by the coupler. However, the coupler disclosed in '565 is a complex arrangement that is difficult to manufacture and install.

SUMMARY OF THE INVENTION

It is the object of the present invention, therefore, to provide an exhaust system for a personal watercraft with an improved design for preventing the flow of water therein towards and into the engine.

It is also the object of the present invention to provide for an improved muffler that makes full use of the muffler space.

It is also the object of the present invention to provide an improved coupling device for coupling exhaust system components.

It is also the object of the present invention to provide an improved water trap device.

The present invention meets the above described need by providing a personal watercraft with an improved exhaust sytem, the watercraft including a hull having a longitudinal axis, an internal combustion engine mounted in the hull, the engine being constructed and arranged to generate power for use in propelling the watercraft and exhaust gas as a by-product of generating power. The exhaust system includes a first muffler and a second muffler, the first muffler being disposed in the hull on one of a port side and starboard side of the longitudinal axis and the second muffler being disposed on the other side of the longitudinal axis. An engine exhaust communication member fluidly communicates the engine with the first muffler. An intermediate exhaust communication member fluidly communicates the first muffler with the second muffler. An outlet exhaust communication member fluidly communicates the second muffler to the atmosphere at an exhaust point on the same side as the first muffler, where the exhaust communication members and the first and second mufflers cooperate to establish an exhaust path from the engine to the atmosphere through which the exhaust gas generated by the engine can flow. The outlet exhaust communication member has a portion between the second muffler and the exhaust point that is higher than both the exhaust point and a point at which outlet exhaust communication member fluidly communicates to the second muffler so that only rotation of the watercraft in a first rotational direction will cause water that has flowed into the outlet exhaust communication member at the exhaust point to flow along the outlet exhaust communication member and into the second muffler. The intermediate exhaust communication member has a portion between the first and second mufflers that is higher than both points at which the intermediate exhaust communication member communicates with the mufflers so that only rotation of the watercraft in a second rotational direction about the longitudinal axis opposite the first rotational direction will cause water that has flowed into the second muffler to flow along the intermediate exhaust communication member and into the first muffler.

The present invention also provides an improved muffler. The muffler includes an outer shell, a transverse wall, and a longitudinally extending plate. An inlet is disposed on a top portion of the outer shell for receiving exhaust gases and water. An outlet is disposed on a top portion of the outer shell for discharging exhaust gases and water collected within the muffler. The transverse wall is disposed intermediate longitudinal ends of the outer shell and between the inlet and the outlet, the transverse wall being connected around a portion of its peripheral edge to an inner surface of the outer shell and having a bottom edge unconnected with the inner surface. The longitudinally extending plate is connected to the bottom edge of the transverse wall and sides thereof are connected to the inner surface of the outer shell. The plate has a substantially free edge, and the plate is disposed beneath the inlet so that exhaust gases entering the muffler impinge against the plate. The transverse wall, the longitudinally extending plate, and the inner surface generally define a first water collection region for water to collect. The plate and inner surface define a channel between an underside of the plate and the inner surface so that exhaust gases and water that spills over the free edge of the plate flow from the first water collection region to a second water collection region.

The present invention also provides an improved exhaust coupler for connecting a first and second exhaust communication members through which exhaust gases flow. The exhaust coupler includes a flange portion extending from an end of the first exhaust communication member, the flange portion being telescopically disposed within the second exhaust communication member, the ends of each of the first and second exhaust communication members being in spaced apart relation to form a space between the ends. A radially-extending protruding member is attached to the flange portion and disposed within the second exhaust communication member, the protruding member being constructed and arranged to inhibit exhaust gases from entering the space. A flexible sleeve is disposed over an outer surface of both the first and second connection members and axially fixed to each thereto and covering the space. An insulating material is disposed within the space, the insulating material including an outer surface engages with the inner surface of the flexible sleeve to protect the flexible sleeve from hot gases within the space.

The present invention also provides an improved water trap device to be connected to an exhaust system of a personal watercraft. The water trap device includes a water trap container having an enclosed internal chamber. A fluid connection member extends through the enclosed internal chamber, the fluid connection member including a water drainage portion having at least one opening formed therein to permit water that has entered the water drainage portion to drain into the enclosed internal chamber. A flow obstructing member is fixed within the water drainage portion with at least one of the openings provided in the water drainage portion on one side of the obstructing member and at least one of the openings provided in the water drainage portion on the other side of the obstructing member, the obstructing member adapted to obstruct flow through the water drainage portion, thus forcing any flow through the water trap device to flow out from the water drainage portion through at least one opening on the one side of the obstructing member and back into the water drainage portion through the at least one opening on the other side of the obstructing member. The fluid connection member has a first end and a second end, each of which extends from the enclosed internal chamber, the first end being constructed and arranged to be connected to a portion of the exhaust path structure that communicates with the engine and the second end being constructed and arranged to be connected to a portion of the exhaust path structure that communicates with the atmosphere so that the fluid connection member constitutes a portion of the exhaust path structure whereby exhaust gases flow from the engine to the atmosphere through the water trap device via the fluid connection member.

Other objects, features, and characteristics of the present invention, as well as the methods of operation of the invention and the function and interrelation of the elements of structure, will become more apparent upon consideration of the following description and the appended claims with reference to the accompanying drawings, all of which form a part of this disclosure, wherein like reference numerals designate corresponding parts in the various figures.

DETAILED DESCRIPTION

Figure 1:
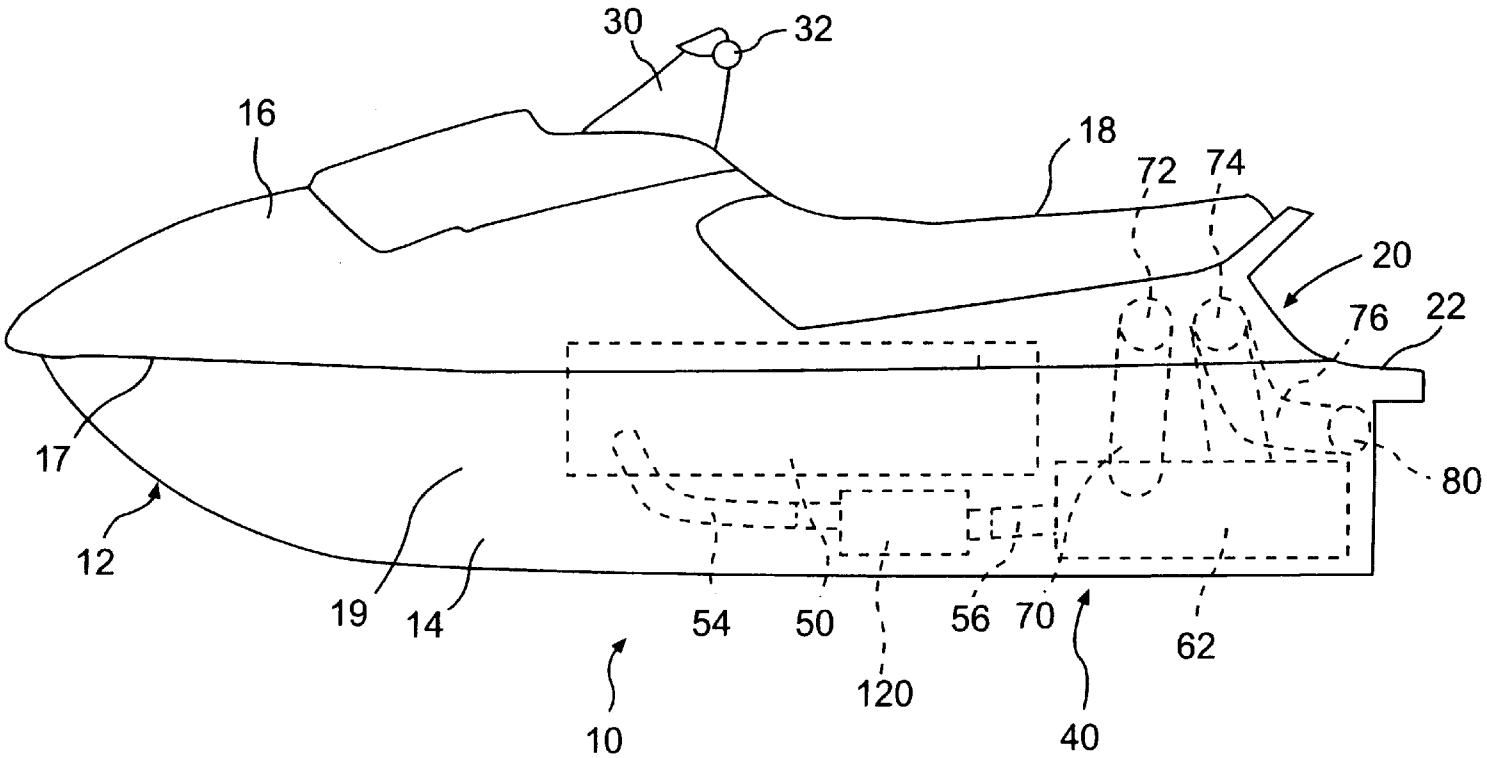
FIG. 1 is a side view of a personal watercraft showing an embodiment of the exhaust system according to the principles of the present invention.

Referring now in detail to the Figures, wherein the same numbers are used where applicable, a personal watercraft constructed in accordance with an embodiment of the invention is identified generally by the reference numeral 10. Although a specific configuration for the watercraft 10 will be described, it should be readily apparent to those skilled in the art that many facets of the invention are adaptable for use with watercraft types considerably different than that disclosed.

In general, a typical personal watercraft 10 is comprised of a hull 14 and a deck 16, which both may be formed from any suitable material such as a molded fiberglass resin or the like. A driver and/or passenger riding on the watercraft 10 straddles a seat 18. The driver steers the watercraft 10 using a steering input structure in the form of handlebars 32 located forwardly of the seat, which is interconnected to a propulsion system, which is generally described below.

An engine compartment 19 is located within the hull 14 below the deck 16. A conventional internal combustion engine 50, which may be either a two-stroke or four-stroke engine, is located within the engine compartment 19. The engine 50 powers a propulsion system in the form of a jet propulsion unit, which is generally indicated as numeral 82 in FIG. 2, the specific details of which are not shown herein and are well known to those skilled in the art. Typically, the internal combustion engine 50 has an output crankshaft (not shown) which is connected to a drive or impeller shaft (not shown) that extends rearwardly from the aft end of the engine 50. The drive shaft drives the jet propulsion unit 82, which is positioned in a tunnel 84 formed on the underside of the hull 14 at the stem of the watercraft 10. The tunnel 84 is substantially centered about the longitudinal axis of the watercraft and includes a discharge opening at the stem of the hull 14 and an intake opening facing downwardly of the hull 14 forwardly of the stem.

The jet propulsion unit 82 may be of any known type and is therefore not illustrated herein in any detail. The jet propulsion unit 82 typically includes an impeller connected to the driveshaft for rotational driving by the engine 50. As the impeller is rotated by the engine 50, the blades of the impeller draw water into the tunnel via the intake opening and expel the drawn water in a pressurized stream through the discharge opening to propel the watercraft 10. A steering nozzle (not shown) adjacent to and in fluid communication with the discharge opening is supported for pivotal movement about a generally vertically extending axis. The pressurized stream of water discharged from the discharge opening flows through the nozzle. As a result, pivoting the nozzle about its generally vertically extending axis changes the direction of the pressurized water stream with respect to the longitudinal axis of the watercraft, and thus steers the watercraft, as is well known in this art. The handlebars 32 are interconnected to this steering nozzle by a typical mechanical linkage or any other suitable mechanism such that manual movement of the handlebars 32 affects pivotal movement of the nozzle as desired by the user to affect steering.

The invention is not limited to a jet propulsion unit or steering by directing a stream of pressurized water. For example, the invention contemplates that it could be applied to an arrangement wherein a standard propeller is mounted outboard of the hull at its stern. Also, steering could be affected by the use of fins and/or rudders instead of directing a pressurized stream of water.

The deck includes a pair of foot wells (not shown) that are disposed on opposite sides of the watercraft. A pair of raised gunnels (not shown) extend along the outer peripheral starboard and port edges of the deck area. At the stem of the watercraft there is a rear platform 22 via which riders may board the watercraft 10 from the body of water in which the watercraft 10 is operating. The upwardly facing surface of the rear platform 22 is substantially at the same elevation as the interface 17 of the hull portion 14 and the upper deck 16.

The construction of the personal watercraft 10 described thus far is conventional. As with most watercraft of this type, because the watercraft may capsize, there is the possibility of water entering the engine through the exhaust system, especially when the rider uprights the watercraft by rotation about its longitudinal axis in a direction opposite to that instructed by the manufacturer. The exhaust system of the invention greatly reduces this problem by providing an improved exhaust system that inhibits water from flowing therethrough to the engine. Even where the watercraft 10 does not capsize, the improved exhaust system of the present invention further inhibits coolant water, which is used to cool the exhaust system via an exhaust system water jacket and which accumulates in the mufflers, from flowing back through the exhaust system to the engine.

Figure 2:
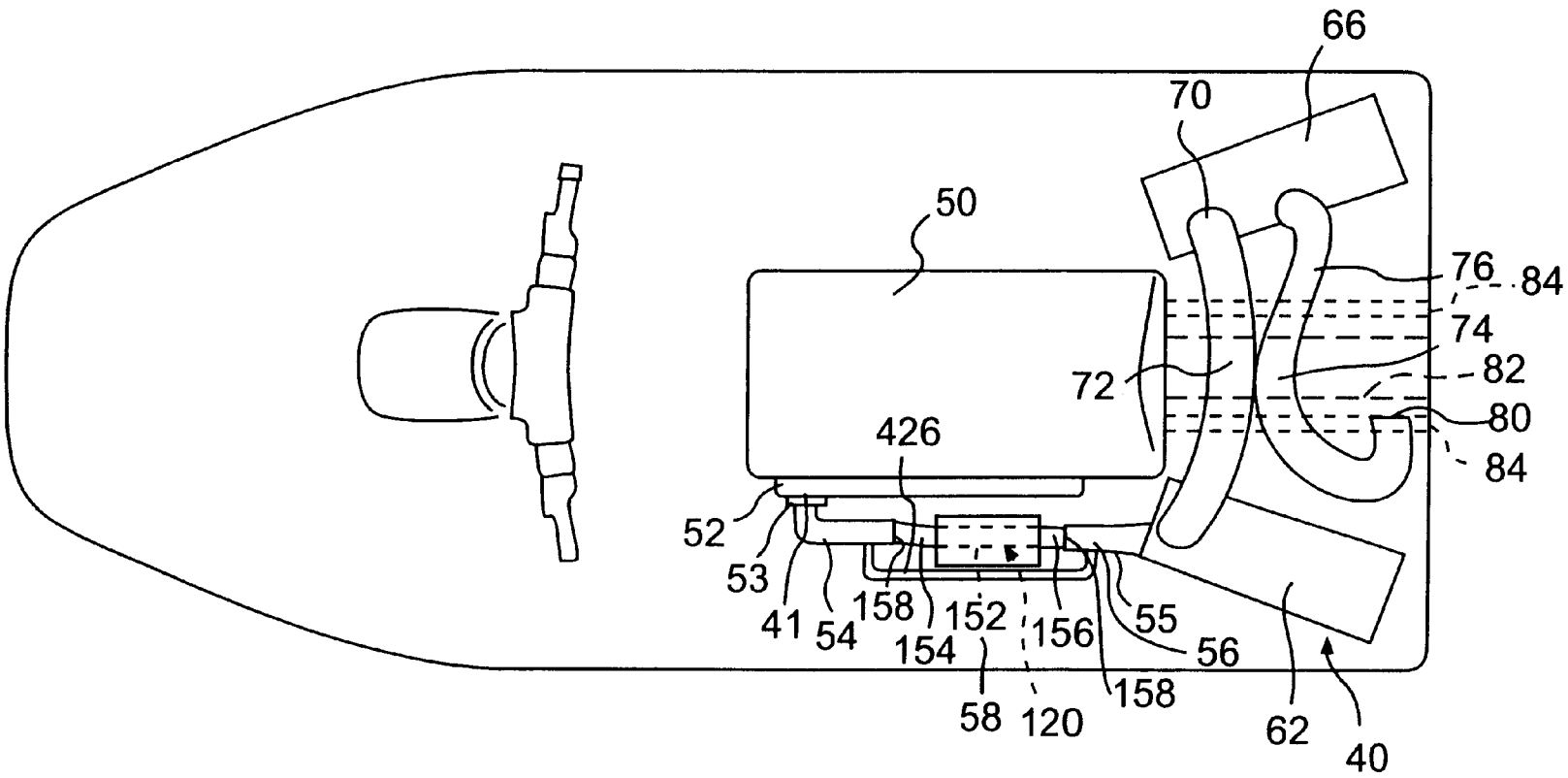
FIG. 2 is a top plan view of the personal watercraft of FIG. 1.
Figure 3:
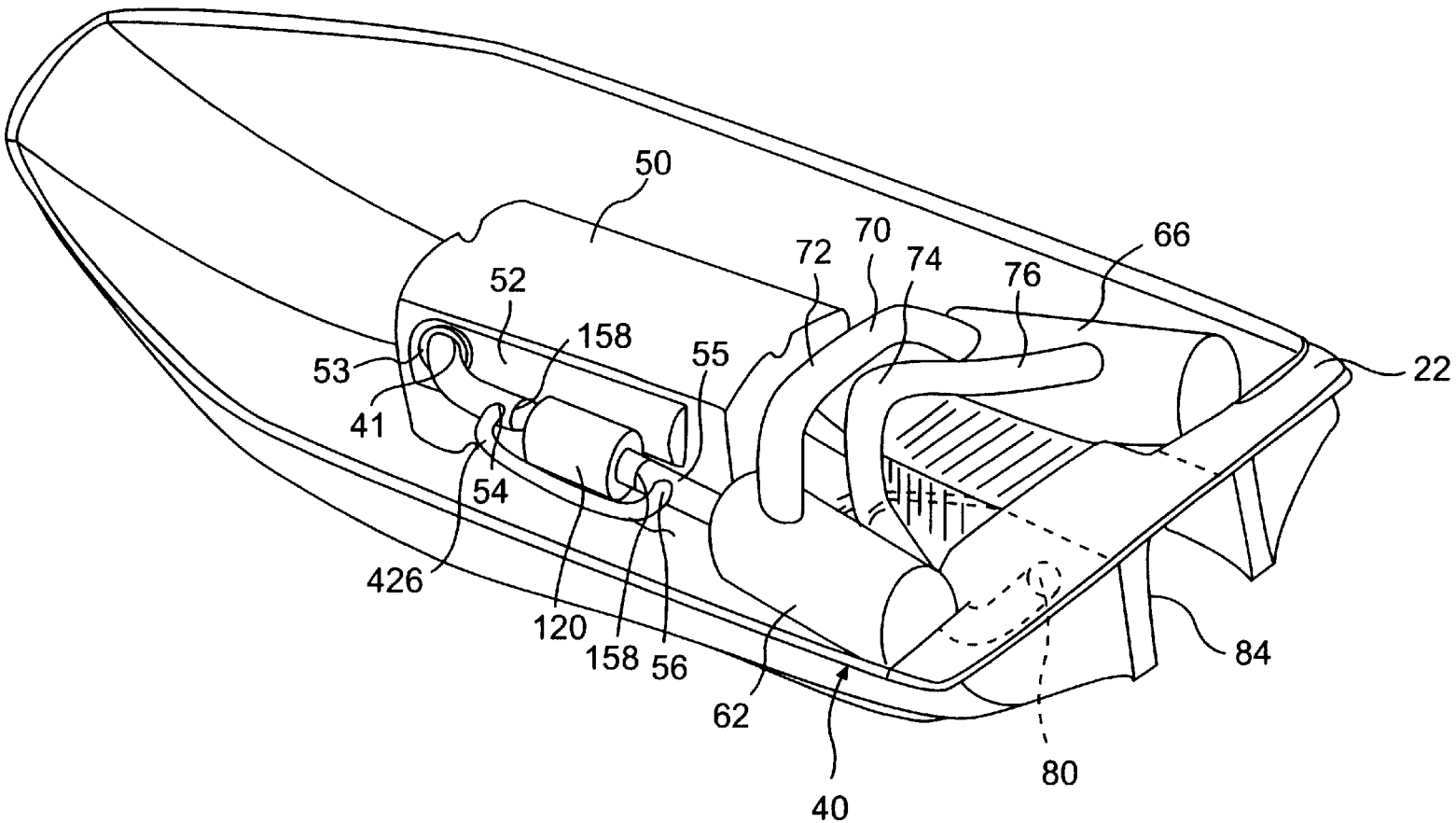
FIG. 3 is a perspective view of the personal watercraft of FIG. 1.

Referring to FIGS. 2 and 3, an embodiment of the exhaust system of the invention will now be described. The exhaust system includes an exhaust path structure, generally indicated as numeral 40, that defines an exhaust path having an inlet end 41 communicating with the engine 50 and an outlet end 80 communicating with the atmosphere such that the exhaust gas generated by the engine flows through the exhaust path structure to the atmosphere. Generally, the exhaust system may include an exhaust manifold 52, which includes a manifold exhaust port 53, an engine exhaust communication member in the form of manifold pipe 54 (or any other suitable type of conduit), first and second mufflers 62, 66, an intermediate exhaust communication member in the form of tubular rubber pipe 70 (preferably made from SAE norm EPDM rubber), an outlet exhaust communication member in the form of tubular rubber pipe 76 (also preferably made from SAE norm EPDM rubber). The exhaust system may further include a water collection member 120 disposed between the first muffler 62 and the engine 50. Instead of using the water collection member 120, a goose-neck pipe 220 may be used in its place, which may be used to connect the first muffler 62 to the exhaust communication member 54 (see FIGS. 8 and 9), the details of which are discussed below. The goose-neck pipe 220 may also be used with a second embodiment of the first and second mufflers 262, 266 (FIG. 8), which are also discussed below. Irrespective of the embodiments used, each of the above components are positioned intermediate the inlet 41 and outlet 80 ends of the exhaust path 40. The engine exhaust communication member 54, the intermediate exhaust communication member 70, and the outlet exhaust communication member 76 are hereinafter referred to as the manifold pipe 54, the transfer pipe 70, and the outlet pipe 76, respectively. The invention, however, is not limited to the use of pipes and any suitable exhaust communication members may be used to communicate the various components of the exhaust system. The water collection member is hereinafter referred to as the water trap container or water trap device 120.

Figure 4:
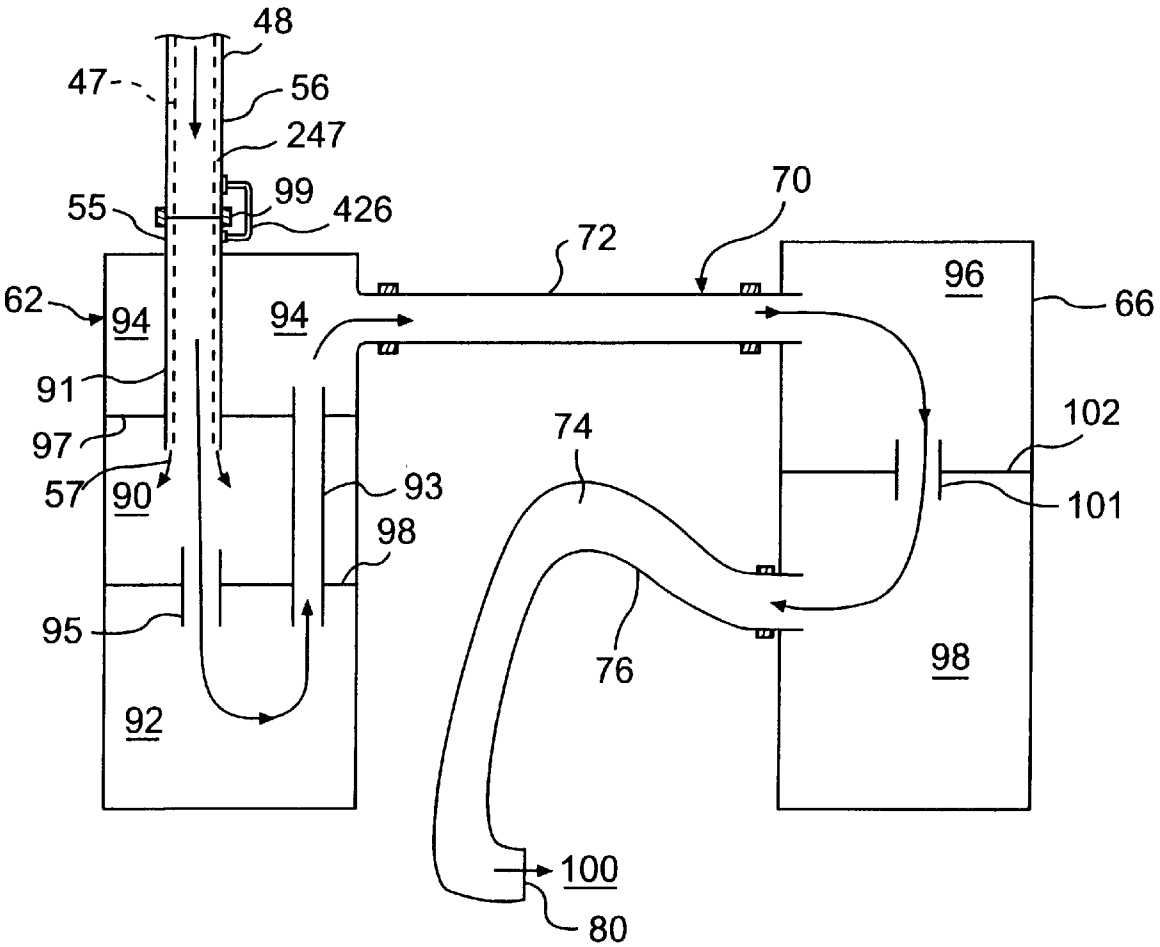
FIG. 4 is schematic of an embodiment the first and second mufflers used in an embodiment of the exhaust system of the personal watercraft of FIG. 1.
Figure 5:
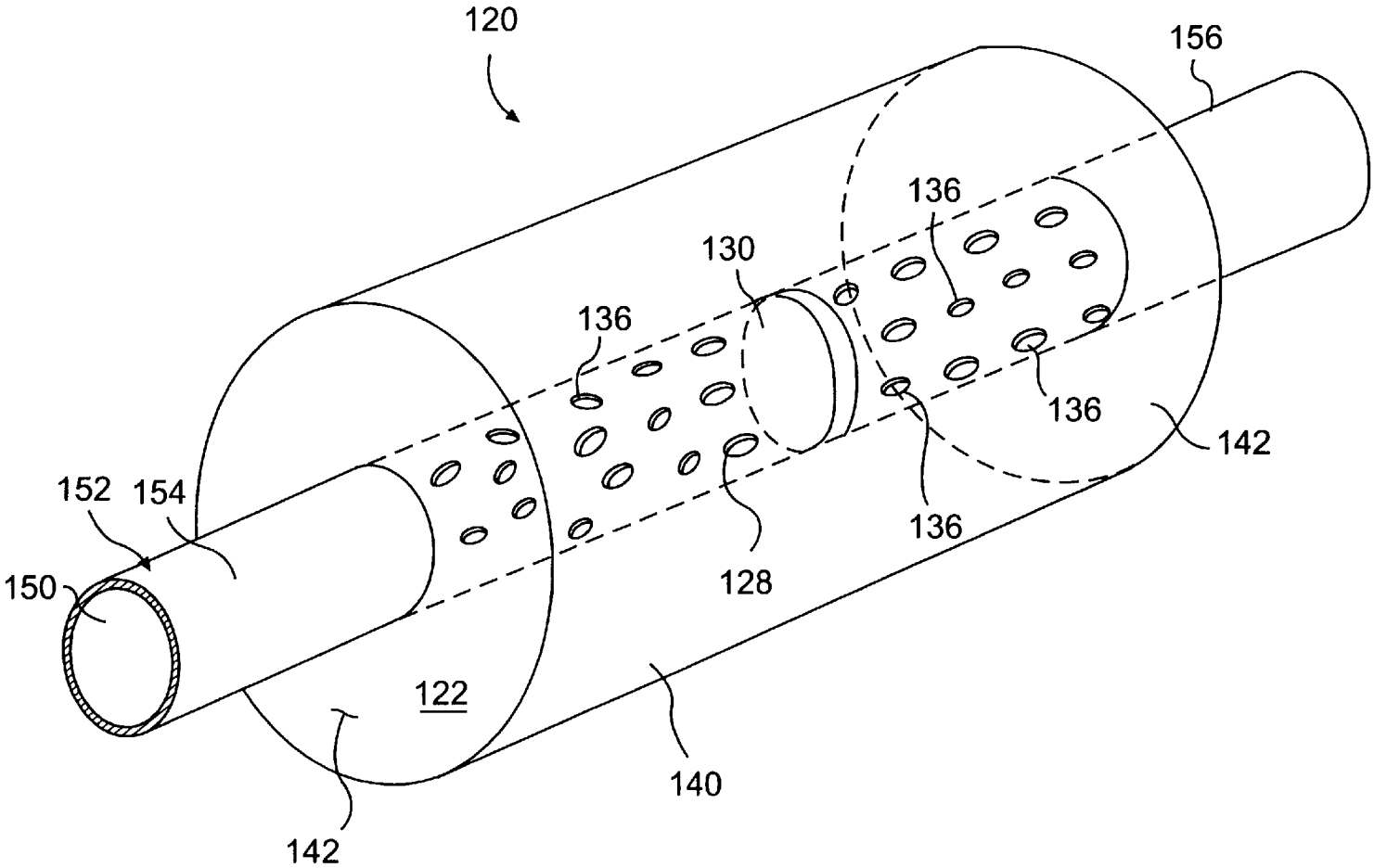
FIG. 5 is a perspective view of the water trap container used in an embodiment of the exhaust system.

Referring to the embodiments shown in FIGS. 2 and 3, the exhaust manifold 52 is mounted to the engine for collecting exhaust gases from the individual combustion chambers of the engine 50. The collected exhaust gases exit the manifold 52 at the manifold exhaust port 53. The manifold pipe 54 is connected at one end to the manifold exhaust port 53 and at the other end to an inlet member 55, which in turn extends into the first muffler 62 to deliver exhaust gases thereto. Alternatively, the manifold pipe 54 may extend directly into the first muffler 62, in which cases a portion 91 of the manifold pipe 54 is disposed within the first expansion chamber 62, as seen in FIG. 4. If the water trap container 120 is installed, the manifold pipe 54 connects to the forward end portion 154 of the fluid connection member 152 that extends through the water trap container 120 (FIGS. 2 and 5). The aft end portion 156 of the fluid connection member 154 connects to an extension pipe 56, which in turn either extends into the first muffler 62 or connects to the inlet member 55 (which in turn extend into the first muffler 62). Although not shown, other devices may also be inserted between the exhaust manifold 52 and the first muffler 62 other than just the water trap container 120, such as a catalytic converter or other device, either forward or rearward of the water trap container 120. Also, although shown being connected to the exhaust manifold 52 at one location, i.e., at the manifold exhaust port 53, the manifold pipe 54 may connect to the exhaust manifold 52 at several locations corresponding to numerous exhaust ports of the exhaust manifold. Or, the exhaust manifold 52 need not be included, and a multi-forked exhaust pipe may connect directly to the engine's combustion chambers, thus combining the function of the manifold pipe 54 and the exhaust manifold 52 into one structure.

Figure 17:
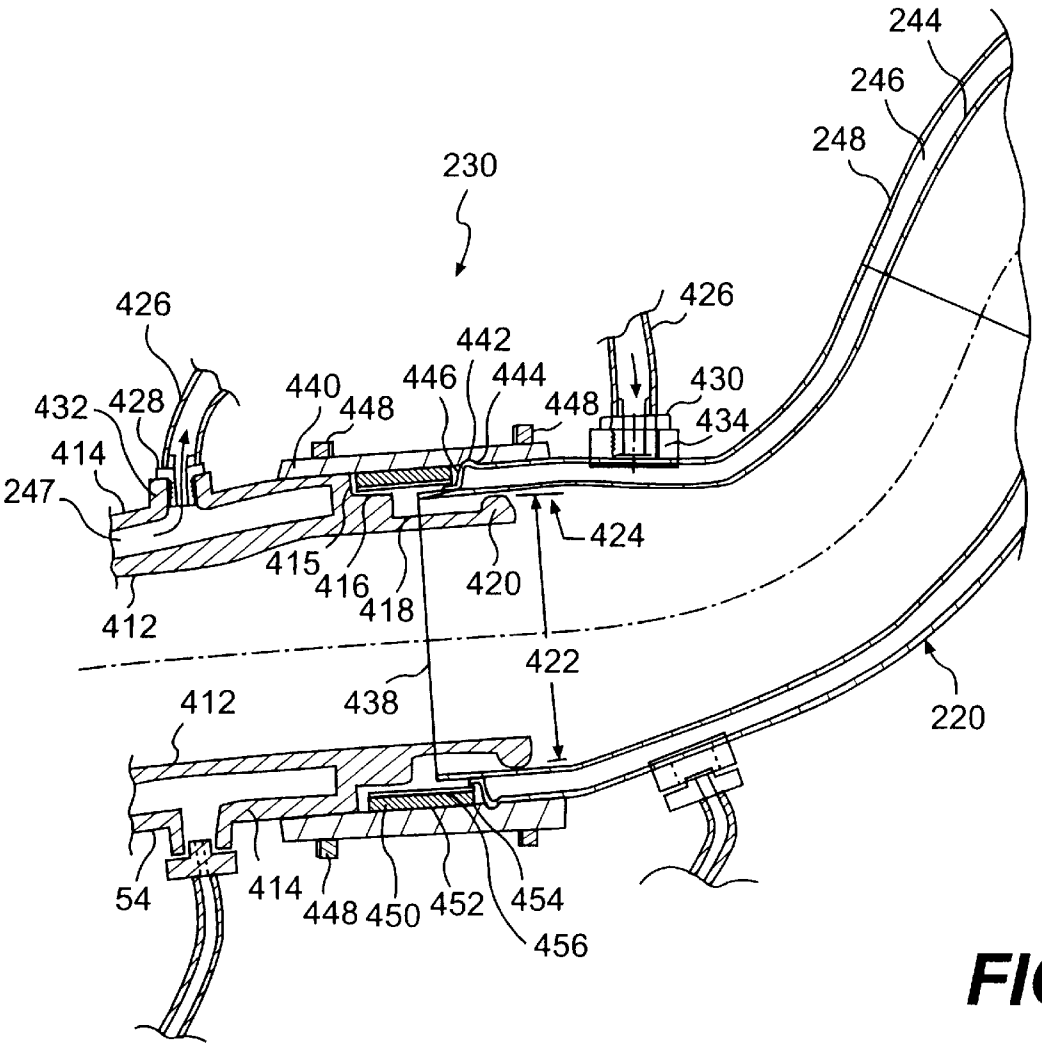
FIG. 17 is section view of the first embodiment of the exhaust coupler used to connect the exhaust manifold with the goose-neck pipe according to the principles of the present invention.

The manifold pipe 54 preferably includes a water jacket 247 formed between diametrically spaced apart inner and outer walls 412 and 414, which is described in more detail below with reference to FIG. 17. Coolant water flows through the water jacket 247 of manifold pipe 54 and is injected into the first muffler, as indicated by the arrows at the outlet 57 of the manifold pipe 54. If an inlet member 55 is installed, as described above, the outlet 57 may be the end of the inlet member 55. If a water container 120 is installed along with an extension pipe 56, the extension pipe 56 may also include a water jacket (not shown). In such a case, the water jacket 247 bypasses the water trap container 120 using a flexible tube 426, which connects the water jacket 247 to the water jacket of the extension pipe 56, as is describe in more detail below with reference to FIG. 17. During normal operation, the coolant water flowing within the water jacket 247 cools the exhaust system and after being injected into the first muffler 62 and collects therein, is blown into the second muffler 66. Thus, both mufflers 62, 66 will be cooled by the injected water during normal operation, and the exhaust system design of the present invention inhibits such water, and water that may enter the mufflers via capsizing, from finding its way back into the engine.

The first and second mufflers 62, 66 are located on the port and starboard sides and at the stem of the watercraft on opposite sides of the tunnel 84. That is, the two mufflers 62, 66 are disposed on opposite sides of the longitudinal axis of the watercraft 10. After the exhaust gases pass through several internal expansion chambers in the first muffler 62, which will be described in more detail below, the exhaust gas is transferred to the second muffler 66 by the transfer pipe 70, which connects the two mufflers 62, 66. The transfer pipe 70 connects to both the first and second mufflers 62, 66 at top portions thereof, as seen in FIG. 3. The transfer pipe 70 is bent generally into a U-shape with portions extending upwards from their respective points of connection to each muffler 62, 66 and over the tunnel 84 to a maximum height at an intermediate portion 72 of the transfer pipe 70. Transfer pipe 70 exits the first muffler 62 from a top portion thereof. The elevation of the intermediate portion 72 of the transfer pipe 70 is higher than the two mufflers 62, 66. More specifically, the elevation of the intermediate portion 72 of the transfer pipe 70 is higher than the points at which the opposing ends of the transfer pipe 70 respectively connect to the two mufflers 62, 66, which is at a top portion of each thereof, respectively.

After the exhaust gases pass through the various internal expansion chambers of the second muffler 66, which will also be described in more detail below, the exhaust gases are then released to the atmosphere via the outlet pipe 76. The outlet pipe 76 has a first end connected to the second muffler 66 and an exhaust end 80. The first end of the outlet pipe 76 is connected to the second muffler 66 at a top portion thereof. Exhaust end 80 of the outlet pipe 76 is positioned beneath the platform 22, and communicates with the tunnel 84 at the rear of the watercraft. The exhaust end 80 may also be positioned to exit at the stern of the watercraft 10 rather than in communication with the tunnel 84, and the exhaust end 80 may also be positioned either at, below or close to the water level. The point at which the exhaust end 80 opens to the atmosphere is referred to as the exhaust point. The outlet pipe 76 extends upward from the second muffler 66 and over the tunnel 84 to an elevation at an intermediate portion 74 of the outlet pipe 76 that is higher than both the second muffler 66 and the exhaust point at the exhaust end 80 thereof. More specifically, the intermediate portion 74 of outlet pipe 76 is at an elevation that is higher than both the point at which the exhaust pipe 76 connects to the second muffler 66 and the exhaust point at the exhaust end 80 thereof.

The exhaust end 80 of the exhaust pipe 76 preferably extends into the tunnel 84 at an elevation where exhaust may be discharged from the exhaust pipe 76 without too much back pressure. In other words, the exhaust end 80 preferably is situated such that exhaust and water can be blown out of the exhaust end 80. If positioned too low in the tunnel 84 (in other words, too low in the water), the water pressure on the exhaust end 80 will be too great and egress of exhaust from the exhaust end 80 will be inhibited (which should be avoided).

In the preferred embodiment of the present invention (illustrated in FIG. 8), the first and second mufflers 262, 266 are inclined so that their rear ends are at a higher point than their forward ends (the rear and forward directions being defined according to the travel direction of the personal watercraft 10). In this embodiment, the transfer pipe 276 preferably extends from the forward portions of the second muffler 266 to the outlet 80. Therefore pipe 270 preferably extends from a forward portion of the first muffler 262 to a rear portion of the second muffler 266. All four of the attachment points of the transfer tubes 271, 276 are preferably at the highest points on the mufflers 262, 266 at the locations where they connect. In other words, the ends of the transfer tubes 270, 276 are positioned to minimize transfer of water therethrough, should the watercraft 10 become inverted during use.

In a further preferred embodiment of the present invention, the transfer tubes 270, 276 are connected to the first and second mufflers 262, 266 at forward-most and rearward-most positions. As in the embodiment depicted in FIG. 8, the transfer tubes 270, 276 connect to the mufflers 262, 266 at the highest point (i.e., the top of the respective muffler). Since the mufflers 262, 266 are inclined so that the rear portions are higher (in elevation) than the forward portions, the points of connection of the transfer tubes 270, 276 to the rear portions of the mufflers 262, 266 are higher than the connection points at the forward portions.

In another embodiment of the present invention, the travel of gases through the first and second mufflers 62, 66 are reversed. In this manner, exhaust gases are directed into the rear of the first muffler 62, preferably at the top of the first muffler 62. The exhaust gases exit the first muffler 62 and are transferred to second muffler 66 through the transfer pipe 70, which extends between the tops of forward portions of the two mufflers 62, 66. As in the previous embodiment, the exhaust gases exit the second muffler 66 through the outlet pipe 76. In this embodiment, because the flow orientation of the first and second mufflers 62, 66 has been reversed, the outlet pipe may be attached to a top portion of the forward-most part of the second muffler 66. Since the second muffler 66 is inclined so that the rear is higher than the forward portion, the outlet pipe 76 is connected to the lowest point on the top of the second muffler 66.

In the two embodiments of the present invention described above, the first and second mufflers 62, 66 are inclined. Moreover, exhaust enters the first and second mufflers 62, 66 at the highest point and exists at the lowest point (on the tops of the mufflers 62, 66). With this arrangement, water is most effectively prevented from entering the engine 50.

The above-described configuration functions effectively to inhibit any water that has entered the exhaust system at the exhaust end 80 of the exhaust pipe 76 from flowing entirely through the exhaust system and into the engine 50, even when the watercraft 10 has capsized. When the engine 50 is running at high power, the ingress of water into the exhaust system is not a problem because the heat and pressure of the exhaust gases will vaporize any water present in the exhaust system and discharge the same into the atmosphere at the exhaust point. However, when the engine 50 is at idle speed, there may be insufficient heat and pressure generated to vaporize the water. Thus, when the engine 50 is at idle speed or is not running and the watercraft 10 is in a normal upright position, water is prevented from entering the second muffler 66 and hence the remainder of the exhaust system because water must flow upwardly against both the direction of the exhaust gases and gravity, respectively, through exhaust pipe 76 in order to reach the second muffler 66.

When capsized, water may enter the outlet pipe 76 because the exhaust end 80 may be underwater. Under most conditions, however, the exhaust end 80 will not be underwater because foam installed in the gunnels will keep the craft sufficiently above the waterline. However, if the watercraft is capsized and the rider sits on the craft, the exhaust end 80 may be forced beneath the waterline, depending upon the location of the exhaust end on the craft. In a case where water does enter the outlet pipe 76 when capsized, if the rider returns the watercraft 10 to its upright position by rotating the watercraft 10 about its longitudinal axis in a clockwise direction (as viewed in FIG. 4) (the clockwise direction is defined as the rotational direction of the boat when viewed from the rear), water in the outlet end 80 of the exhaust pipe 76 will be prevented from flowing towards the second muffler 66 by its own inertia. However, if the watercraft 10 is returned to the upright position by rotation about its longitudinal axis in a counterclockwise direction (as viewed in FIG. 4), water present in the outlet end 80 of the outlet pipe 76 will tend to flow along the outlet pipe 76 towards and into the second muffler 66 by its own inertia. Similarly, any water present in the first muffler 62 will tend to flow from the first muffler 62 to the second muffler 66. During this counterclockwise rotation, the outlet pipe 76 basically "scoops" water into the end of the outlet pipe 80 and the continued counterclockwise rotation of the watercraft 10 causes this "scooped" water to flow along the outlet pipe 76 and into the interior of the second muffler 66. Similarly, during a counterclockwise rotation, the transfer pipe 70 basically "scoops" water from the first muffler 62 and directs it to the second muffler 66.

Assuming the user of the watercraft 10 has capsized the watercraft and mistakenly uprighted the watercraft 10 by rotation in the counterclockwise direction, the rotation of the watercraft 10 is likely to have caused water to flow into the second muffler 66. However, at this point in the uprighting of the watercraft, the first muffler 62 remains free of cooling water. Because the intermediate portion 72 of the transfer pipe 70 has an elevation that is higher than the points at which the transfer pipe 70 connects to both the mufflers 62, 66 (and because water present in the first muffler 62 will have been transferred to the second muffler 66), the water in the second muffler 66 will be prevented from flowing along the transfer pipe 70 and into the first muffler 62. Restarting the engine 50 generates exhaust gases with sufficient pressure and heat to displace the water from the second expansion chamber 62 as described above.

Prior to restarting the engine 50, in order to cause the water in the second muffler 66 to flow along the transfer pipe 70 to the first muffler 62, the watercraft must be again capsized and then subsequently rotated in the clockwise direction. By rotating the watercraft 10 in the clockwise direction, the water in the second muffler 66 will be caused to flow under its own inertia along the transfer pipe 70 towards and into the first muffler 62. Any water present in the outlet pipe 76 will tend to flow out of the exhaust outlet end 80 into the body of water in which the watercraft 10 is being operated.

In the unlikely event that entrant water is able to find its way through both the first and second mufflers 62, 66, the water trap container 120, which, when installed, is preferably located between the first muffler 62 and the engine 50, will minimize the likelihood that this water will reach the engine 50 through the manifold 52. Of course, the water trap container 120 can also be included in an exhaust system having more or less than two mufflers. The particular layout for the exhaust system shown in the Figures and described herein is provided simply for illustrative purposes and is not intended to be limiting. That is, generally, the water trap container 120 can be positioned anywhere between the inlet 41 and the outlet 80 ends of the exhaust path, the exhaust path being defined by the exhaust path structure 40, described above.

As shown in FIG. 5, the water trap container 120 surrounds and encloses an internal chamber 122. The water trap device includes a fluid connection member 152 extending through the enclosed internal chamber 122. The fluid connection member 152 comprises a water drainage portion 128 having at least one opening 136 formed therein to permit water that has entered the water drainage portion 128 to drain into the enclosed internal chamber 122, thus inhibiting the water from flowing into the engine 50 via the inlet end 41. Restarting the engine 50 generates exhaust gases with sufficient pressure and heat to displace the water from the water trap container 120.

In the illustrated embodiment, the water trap container 120 includes a flow obstructing member 130 disposed within water drainage portion 128. The flow obstructing member 130 is positioned within the water drainage portion 128 such that at least one of the openings 136 is on one side of the obstructing member and at least one other opening 136 is provided on the other side of the obstructing member, thus forcing any exhaust flow through the water trap 120 to flow out from the water drainage portion 128 through at least one opening 136 on one side of the obstructing member and back into the water drainage portion through at least one opening on the other side of the obstructing member 130. Thus, if a large volume flow of water enters the water drainage portion 128, the flow obstructing member 130 will prevent the water from merely passing therethrough, and insures that any such entrant water, and the exhaust gases, are forced into the internal chamber 122 via the openings 136. Forcing the exhaust gases into the internal chamber 122 helps to attenuate engine sound by the expansion thereof. The flow obstructing member 130 may be made of metal that is welded, brazed, soldered, or otherwise attached at an intermediate portion of the water drainage portion 128 so as to obstruct fluid flow. It is also contemplated that the flow obstructing member 130 may be a rubber, plastic, any other suitable material or structure that is interferingly fitted within the water drainage portion 128.

Figure 7:
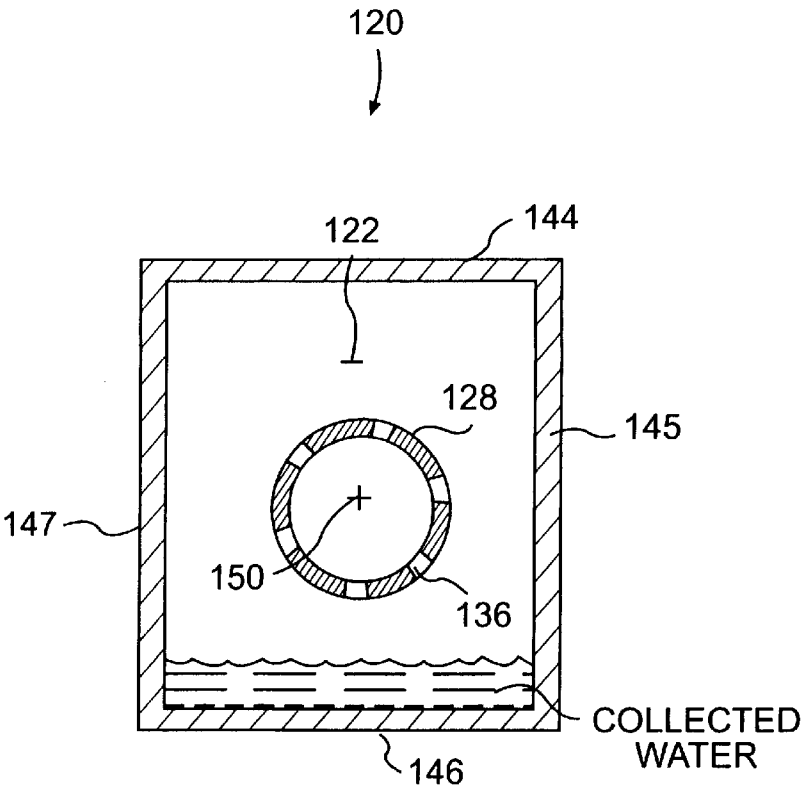
FIG. 7 is a cross sectional view of the water trap container shown in FIG. 5, having a rectangular cross-section.

In the illustrated embodiment, the water trap container 120 is cylindrical in shape and includes a main cylindrical wall 140 encircling the enclosed chamber 122 and a pair of end walls 142 closing off opposing ends of the cylindrical wall to enclose the internal chamber. The enclosed chamber 122 can also have a rectangular, cross-sectional shape, as shown in FIG. 7, in which case the main wall enclosing chamber 122 is made of rectangular portions 144–147 that are connected together along their respective edges, and end walls that close off opposing ends would, likewise, be rectangular. While the water trap container 120 has been described with a circular or rectangular cross-section, those skilled in the art would readily recognize that the water trap container 120 could be manufactured with a triangular or polygonal cross-section (or any other suitable cross-section for that matter).

Figure 6:
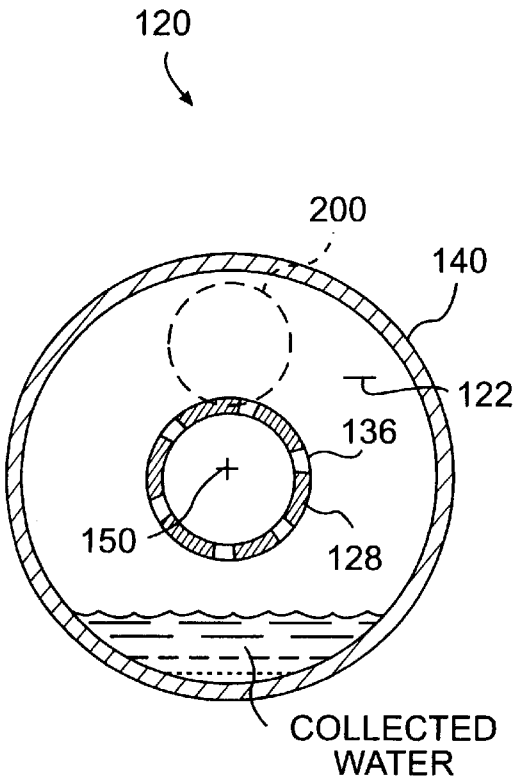
FIG. 6 is a cross sectional view of the water trap container shown in FIG. 5.

In the preferred embodiment, the water drainage portion 128 includes a plurality of openings 136. Each opening 136 may be drilled, punched, or otherwise formed in the water drainage portion 128. The water drainage portion 128 further extends through the enclosed chamber 122 substantially along the longitudinal axis 150 of the water trap container 120. The water drainage portion 128 may also extend through the enclosed chamber at a location above the longitudinal axis, as indicated by the dashed line 200 in FIG. 6, which would permit a greater amount of water to be collected in the enclosed chamber 122.

While not shown, the water trap container 120 may also be provided with a drain at a bottom most portion to permit water to be removed from the water trap container 120 during operation. The drain preferably is positioned at the lowest-most portion of the water trap container 120. Preferably, the drain is a check valve that opens when a certain amount of water pressure is applied to it.

In the preferred embodiment, the water trap can be a separate water trap device 120 that is inserted into the exhaust system. In this case, the fluid connection member 152 has a forward end portion 154 and an aft end portion 156, each of which extends from the enclosed internal chamber 122. Here, the water trap device 120 is constructed and arranged to be connected to the exhaust system of the watercraft 10 at a location intermediate the inlet end 41 and the outlet end 80 of the exhaust path structure 40, wherein the first end is constructed and arranged to be connected to a portion of the exhaust path structure that communicates with the engine 50 and the second end is constructed and arranged to be connected to a portion of the exhaust path structure that communicates with the atmosphere so that the fluid connection member 152 constitutes a portion of the exhaust path structure whereby exhaust gases flow from the engine 50 to the atmosphere through the water trap device 120 via the fluid connection member 152. The first and second ends may be connected to either manifold pipe 54 or extension pipe 56 using conventional U-bracket clamps, welding, brazing (all of which are represented as element 158), or otherwise connected, as is known in the art.

In another embodiment, the water trap container 120 is positioned intermediate the engine 50 and the first muffler 62, with the manifold pipe 54 extending through the enclosed chamber of the water trap container and providing the water drainage portion 128 of the exhaust path.

All of the components of the water trap container 120 are preferably made from metal, and the water drainage portion 128 is preferably made of tubular metal pipe. However, other suitable material known in the art may be used, such as plastic. In the preferred embodiment, all of the components of the water trap container 120 are welded or brazed together. Of course, if the flow obstructing member 130 is not metal, it is not attached to the water trap container 120 via welding.

Although the primary function of the water trap container 120 is to collect entrant water therein and prevent the water from reaching the engine 50, the water trap container has at least two other secondary functions. First, since the water trap container 120 includes structure that allows the expansion of exhaust gases that pass through the water trap, i.e., by passing through the plurality of openings 136 and into the enclosed chamber 122, the water trap container 120 attenuates engine sound. Second, the expansion and contraction of the exhaust gases within the water trap container 120 creates a degree of back pressure, which helps engine performance.

As can be readily appreciated, the exhaust system designed in accordance with the present invention makes it very difficult for a user to cause water to flow through the exhaust system and into the engine 50. More specifically, the exhaust system is designed so that only a very specific set of watercraft movements will allow the water to flow therethrough and into the engine 50. This greatly minimizes the chances of such an occurrence and thus minimizes the chances of engine damage resulting from such an occurrence.

Although the movements of the watercraft 10 have been described in terms of clockwise and counterclockwise movements, the exhaust system may be designed as a mirror image of the one illustrated. Thus, the invention can be characterized in terms of a first rotational direction about the longitudinal axis of the watercraft 10 and a second rotational direction about the longitudinal axis of the watercraft 10 opposite the first rotational direction.

As is well known in the art, the expansion of the exhaust gases within mufflers attenuates engine sound and are widely used in conjunction with internal combustion engines in order to reduce engine noise. The internal structure of the first embodiments of the mufflers 62, 66 are shown in FIG. 4. The first muffler 62 has three internal expansion chambers, referred to as the first 90, second 92, and third internal expansion chambers 94. The three chambers 90, 92, 94 are separated by transversely extending baffles 97, 98. While, the exhaust gases sequentially pass through the first, second, and third internal expansion chambers 90, 92, 94, the three chambers are not disposed in sequential order within the first muffler 62. The third internal expansion chamber 94 is located at a forward end of the muffler 62, the second internal expansion chamber 92 is located at the other end of the expansion chamber 62, and the first internal expansion chamber 90 is located between the second and third internal expansion chambers 92, 94. Tuning tubes 91, 93, and 95 extend through the baffles 97, 98 for communicating the internal expansion chambers 90, 92, 94 with one another as illustrated. While the tuning tubes 91, 93, 95 are illustrated as straight tubes, those skilled in the art would readily appreciate that the tuning tubes 91, 93, 95 could be curved. In fact, in one embodiment of the present invention, it has been contemplated that the ends of the tuning tubes may be bent to prohibit the flow of water therethrough.

After passing through the water trap device 120 (or container 120), which may optionally be installed, the exhaust gases are delivered to the first muffler 62 via transfer pipe 56, which is connected to tuning tube 91 by a connecting mechanism 99, which may be a U-clamp or other connecting mechanism. The connecting mechanism 99 may also be an exhaust coupler device 230 (described below). Alternatively, connecting mechanism 99 may be a flexible connection mechanism 228, as is described below with reference to FIG. 9. Tuning tube 91 extends through the third internal expansion chamber 94 and opens into the first chamber 90. Thus, the exhaust gas bypasses the third chamber 94 and is delivered directly to the first internal expansion chamber 90. After expanding in the first chamber 90, the gases then enter the second chamber 92 via tuning tube 95. After expansion and further attenuation of engine sound within the second expansion chamber 92, the gases then reverse direction and enter the third chamber 94 via tuning tube 93, which extends through the first expansion chamber 90. As shown in FIG. 3 and FIG. 4, the transfer pipe 70 is also connected to the first muffler 62, at a top portion thereof, and extends into the third expansion chamber 94 for allowing the exhaust gases expanded therein to flow into the second muffler 66. Thus, a tortuous path is created in which the exhaust gases, after entering from the forward end, must travel the complete length of the muffler 62, reverse direction and travel back to the forward end before exiting from the third internal expansion chamber 94 via the transfer pipe 70.

Likewise, any water that enters the first muffler 62 must travel a tortuous route that is the reverse of the one for the exhaust gas in order to flow from the transfer pipe 70 through the various internal expansion chambers 90, 92, 94 to the pipe 55, 91 that extends into the first expansion chamber 62. This adds a further safety factor in preventing the flow of water towards and into the engine. In the unlikely event that entrant water should find its way past the first muffler 62, or that coolant water backs up into pipe 55, 91, the water trap device 120 will further prevent the water from reaching the engine 50.

The exhaust gases are transferred from chamber 94 via the transfer pipe 70 to the second muffler 66, shown with two internal expansion chambers 96 and 98 connected by tuning tube 101 and separated by a transversely extending baffle 102. The exhaust gases pass through the these two internal expansion chambers for further silencing and then exit to the atmosphere 100 via the outlet pipe 76, which is connected to internal chamber 98. It is noted that all the internal expansion chambers 90, 92, 94, 96, and 98 have different volumes. Although the first and second mufflers 62, 66 are shown with three and two internal expansion chambers, respectively, the number of internal expansion chambers in each device may vary from that shown.

It is noted that the shape of the internal expansion chambers 90, 92, 94, 96, 98 serves at least two functions in reducing the overall noise generated by the watercraft 10. First, the cross-section of the internal expansion chamber 90, 92, 94, 96, 98 determines the amplitude of the sound that will be muffled thereby. Second, the length of the internal expansion chamber 90, 92, 94, 96, 98 determines the frequency of the sound that will be muffled.

The embodiment shown in FIGS. 1–3 is an exemplary configuration only, and the various components may vary in number, size, and shape. For example, although shown with two mufflers 62, 66, one skilled in the art will recognize that any number of expansion chambers could be utilized, with the only constraint being their size and the limited space available within the watercraft hull. Accordingly, multiple transfer pipes would be required as well. Additionally, the general configuration of the components relative to each other can vary significantly.

Figure 8:
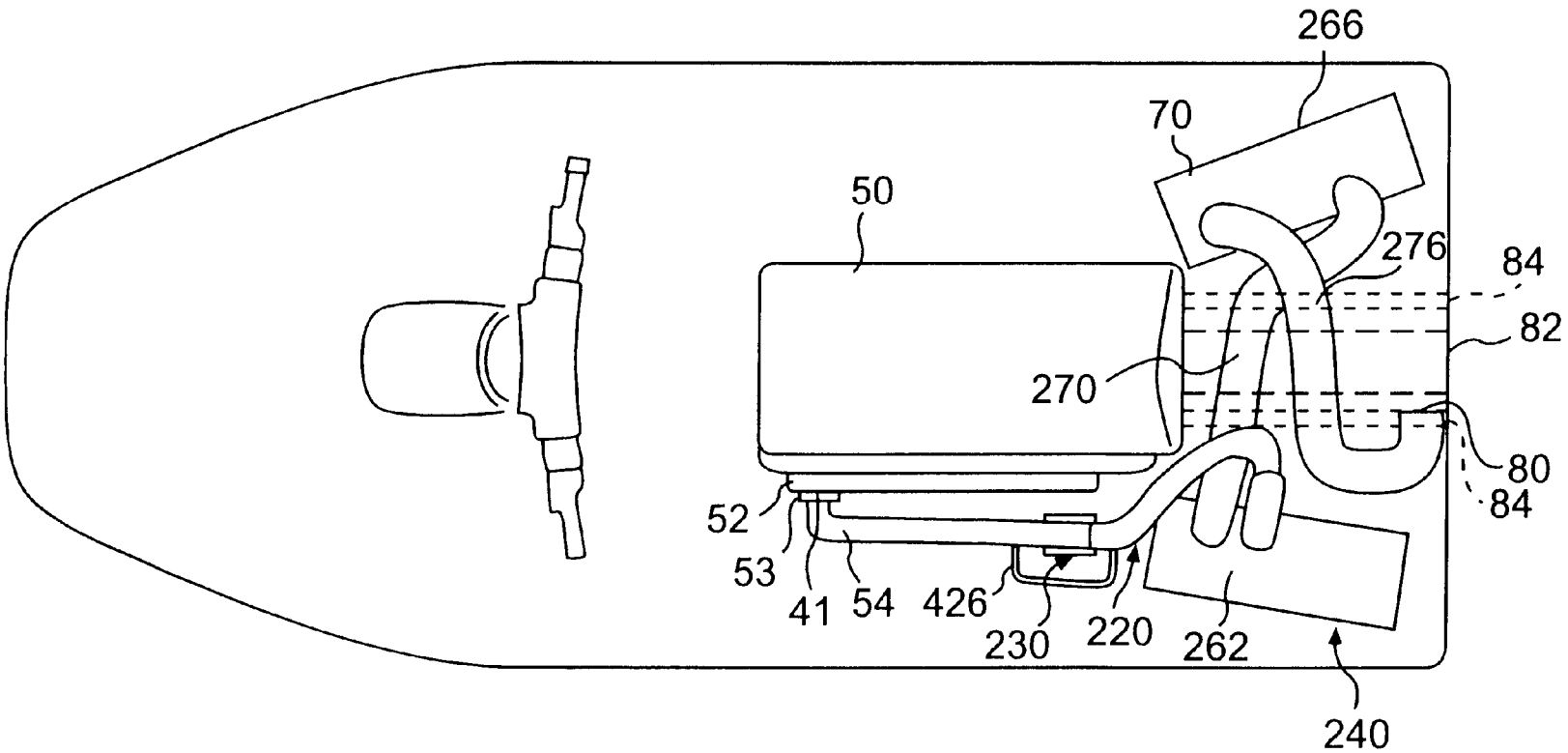
FIG. 8 is a side view of a personal watercraft showing another embodiment of the exhaust system according to the principles of the present invention.
Figure 9:
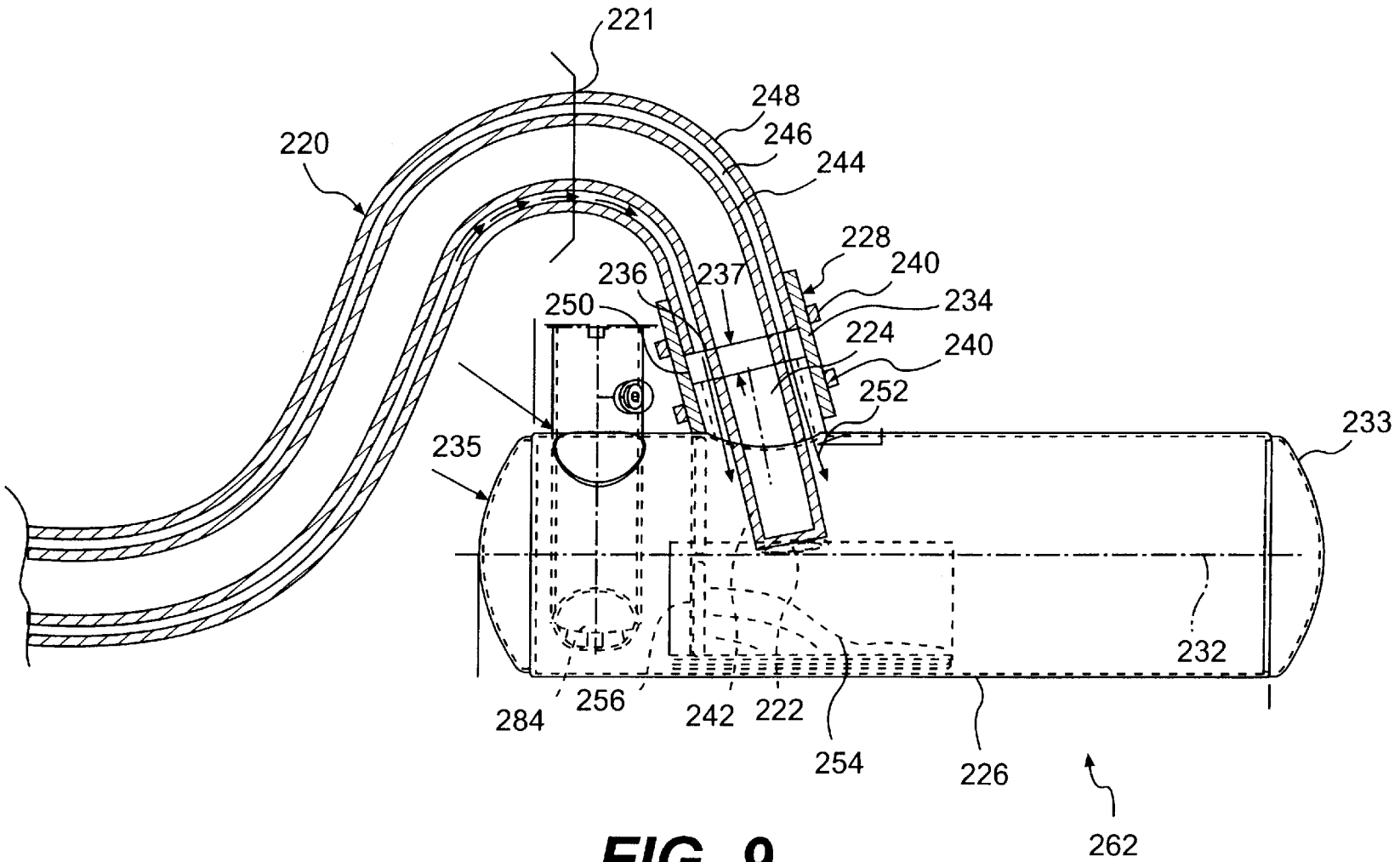
FIG. 9 is side view of another embodiment of the first muffler and the goose-neck pipe used in the exhaust system of FIG. 8.

For example, referring to FIGS. 8 and 9, in which like reference numerals are used for like elements of the first embodiment, a second embodiment of the exhaust system, generally indicated as reference numeral 240, will now be described. In this second embodiment, the first and second mufflers 262, 266, and, consequently, the transfer pipe 270 and outlet pipe 276 have different configurations from that described above in the first embodiment. Also, this second embodiment of the exhaust system 240 utilizes, as mentioned earlier, a goose-neck pipe 220, rather than using the water trap device 120 as in the first embodiment. However, the water trap device 120 of the first embodiment may be in installed in this second embodiment as well. Connection of the goose-neck pipe 220 to the manifold pipe 54 is accomplished using various embodiments of a connecting mechanism 230 designed to prevent the transmission of engine vibration to the remainder of the exhaust system, which is described in detail below.

The structure of the first and second expansion chambers 262 and 266 is now described. Exhaust gas passes through the goose-neck pipe 220 and enters the first muffler 262 via inlet 222. The goose-neck pipe 220 is mounted to an extension member 224 that extends from the outside surface 226 of the first muffler 262 using a flexible connection mechanism, generally indicated as 228. The axis of the extension member may be slightly angled with respect to a line perpendicular to the central axis 232 of the first muffler 262. The flexible connection mechanism 228 may include a flexible sleeve 234 held to the extension member 224 and the end 236 of the goose-neck pipe 220 by clamps 240. The goose-neck pipe 220 also includes an insertion pipe 242 that may extend to approximately the central axis 232 of the first muffler 262. This insertion pipe 242 runs the full length of the goose-neck pipe 220 and forms the inside wall 244 of the cooling water jacket 246 of the goose-neck pipe, the outside wall 248 being formed by the outer wall of the goose-neck pipe. Cooling water is directed into this cooling water jacket 246 (from the cooling water jacket 247 in the manifold pipe 54 via 426) and exits via the annular opening 250 at the end 236 of the goose-neck pipe 220, as indicated by arrows 252, and collects within the first muffler 262.

A gap 237 exists between the end 236 of the goose-neck pipe 220 and the beginning of extension member 224. The gap 237 exists within flexible sleeve 234.

Figure 11:
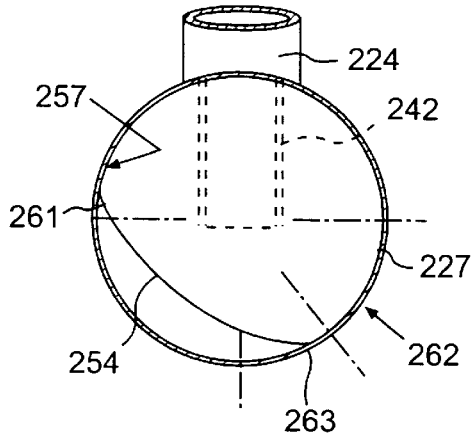
FIG. 11 is a back view of the first muffler shown in FIG. 9.
Figure 12:
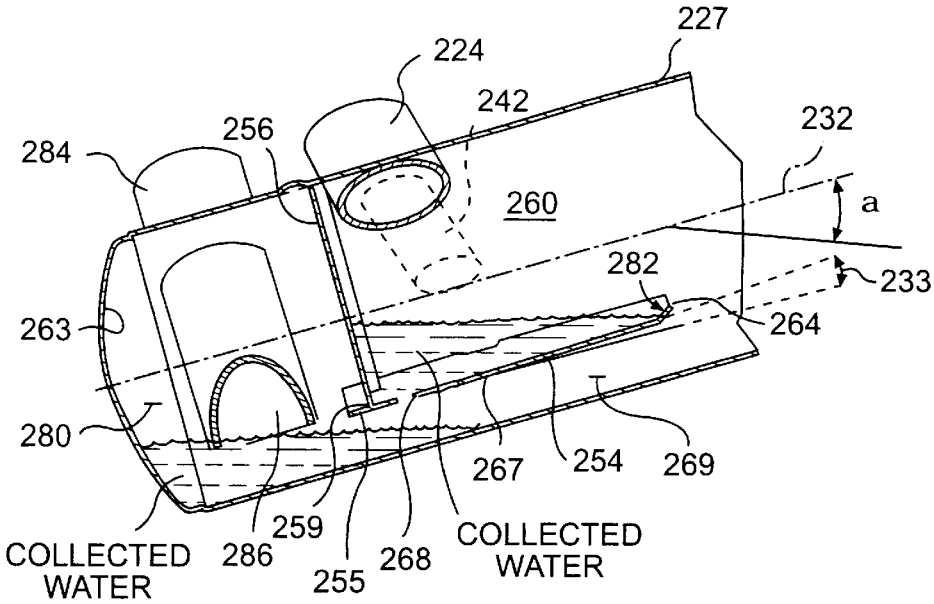
FIG. 12 is another side view of the first muffler shown in FIG. 9.
Figure 13:
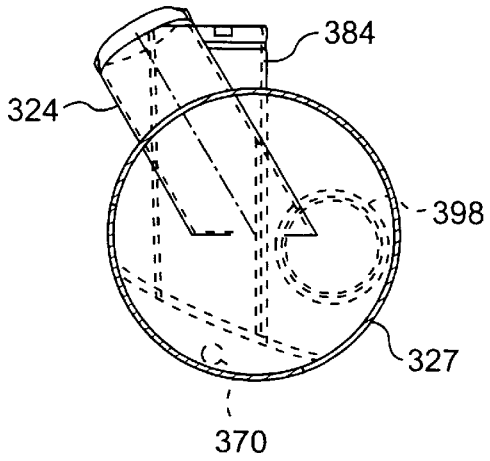
FIG. 13 is front view of another embodiment of the second muffler used in an exhaust system of FIG. 8.

Referring now to FIG. 12, the first muffler 262 includes a first transverse wall 256 disposed intermediate the longitudinal ends 233, 235 thereof and between the inlet 222 and the outlet 284. The first transverse wall is connected around a portion of its peripheral edge 257 to the inner surface of the outer shell 227 muffler and has a bottom edge 259 that is not connected to and spaced apart from the inner surface. A longitudinally extending plate 254 is fixedly connected to the outer shell 227 of the device 262, as better seen in FIGS. 10–12. The longitudinally extending plate 254 includes a forward portion 255 connected to the bottom edge 259 of the first transverse wall 256, sides 261, 263 connected to the inner surface of the outer shell 227, and an aft edge 264 that is substantially a free edge. The plate 254 is preferably welded or brazed to the inner surface of the muffler 262 in such a manner to form a substantially liquid tight seal therebetween. The longitudinally extending plate is preferably concave with respect to the axis 232 of the muffler 262. The concave plate 254 reinforces the first muffler 262 to make it stronger. The concave plate 254, being disposed beneath the inlet 222, also protects the outer wall from the high heat of the exhaust gases, where the exhaust gases directly impinge against the concave plate 254 rather than against the outer wall of the muffler.

In addition, the concave plate 254 is designed with this shape so that water droplets do not fall into the inlet 222 if the watercraft 10 is inverted during operation. In particular, if the concave plate 254 were convex, the plate would establish a ridge, when inverted, on which water could collect. Upon inversion of the watercraft, some of that water might have a tendency to fall from the ridge and enter the inlet 222. Since the plate 254 is concave, however, the water has no area over inlet 222 on which it can collect (or aggregate). As a result, entry of water into inlet 222 is minimized.

The aft region within the muffler 262 that is generally bounded by the first transverse wall 256, the concave plate 254, and the inner surface of the muffler defines a first water collection region 260. Hence, the transverse wall 256 is preferably welded or brazed to the outer wall of the muffler 262 in such a manner to form a substantially liquid-tight seal therebetween. Since the first muffler 262 is tilted upwards from the horizontal by an angle alpha (i.e., the aft ends of each of the first and second mufflers are raised higher than the forward ends thereof with respect to hull of the watercraft), as water enters the device 262 via the annular opening 250, it collects in this first water collection region 260, as illustrated in FIG. 12. The underside 267 of the concave plate 254 and the inner surface of the muffler forms a channel 269 therebetween so that exhaust gases and water that spills over the free end 264 of the concave plate flow to the forward end of the muffler 262. As the first water collection region fills, it spills over the free end 264 of the concave plate 254, flows through channel 269, and collects in a second water collection region 280, which is generally the space forward of the transverse wall 256 and bounded by the forward longitudinal wall 235 and outer wall 227 of the muffler 262.

Due to the design of the muffler 262, water collects between the concave plate 254 and the transverse wall 256 when the watercraft 10 is in the upright operating position. The water that collects in this region acts as a water jacket to keep the muffler 262 cool. In particular, as the hot exhaust gases enter the muffler 262 through the inlet 222, the water that collects between the transverse wall 256 and the concave plate 254 absorbs some of the heat from the exhaust gases to prevent the concave plate 254 (and, consequently the muffler 262) from becoming excessively hot.

The concave plate 254 includes a small through-hole 268 located proximate the bottom edge 259 of the transverse wall 256 on the aft side thereof. This through-hole 268 permits collected water in the first water collection region 260 to escape into the second water collection region 280, thus controlling the amount of water that collects in the first water collection region 260. That is, as the water collected in the first water collection region 260 increases and the water pressure increases, the amount of water that escapes through hole 268 increases. Though not intended to be limiting, the through-hole 268 may be approximately 10 millimeters (0.39 inches) in diameter. The free end 264 of the concave plate 254 includes an upwardly curved portion or lip 282, which allows for a more consistent dripping of the water from the first water collection region 260 to the outer wall of the first muffler 262. Consistent dripping helps to cool the outer wall. The line of contact between the concave plate 254 and the interior wall of the muffler 262 is tilted slightly upward with respect to the central axis 332 by an angular amount given by reference numeral 233. Though not intended to be limiting, this angular amount 233 may be approximately one degree relative to the axis 232 of the muffler 262.

The concave plate 254 and the outer shell 227 define a channel 269 therebetween that extends from the first water collection region 260 to the second water collection region 280. The concave plate 254 also extends at a slight angle 233 upwardly. The angle 233 of the concave plate 254 creates an channel 269 that increases in cross-sectional size from the transverse wall 256 to the free end 264. The increase in cross-sectional size of the channel 269 acts like a megaphone where there is a greater sound pressure at the larger end (near the free end 264) than at the smaller end (near the transverse wall 256). Since a smaller sound pressure is established at the end of the channel 269 near the transverse wall 256, the shape of the convex plate 254 (as defined by the angle 233), creates a suction in the channel 269 in a direction from the transverse wall 256 to the free end 264.

Figure 10:
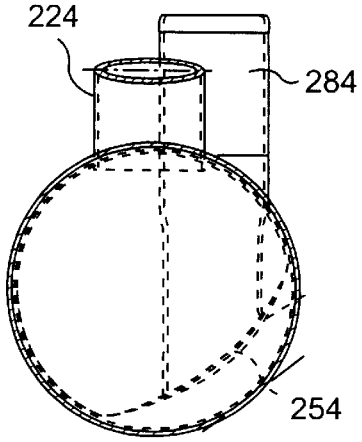
FIG. 10 is a front view of the first muffler shown in FIG. 9.

An outlet extension member 284 extends from the second water collection region 280 outward of the first muffler 262 from an upper portion thereof. The intake 286 of the outlet extension member 284 is located approximately at the same spatial location as the concave wall 254, as best seen in FIG. 10. However, the end shape and location of the end of the outlet extension member is not limiting, and can take on any other shape or location. The outlet extension member 284 is connected to a transfer pipe 270 for communicating exhaust gases and collected water to the second muffler 266.

The collected water in the first muffler 262 is transferred to the second muffler 266 in two ways. First, the collected water evaporates and is transferred to the second muffler 266 along with the exhaust gases via the transfer pipe 270. Second, when the collected water in the second water collection region 280 rises higher than the intake 286 to cut off the flow of exhaust gases, pressure builds up in the first muffler 262 and when the pressure is high enough, it pushes the water, with a burst, into the second muffler via the transfer pipe 270. After such a burst, the water level again increases due to the entrant water from the cooling jacket of the goose-neck pipe 220 and the process repeats itself.

It is noted that the first muffler 262 does not include enclosed internal chambers, in contrast with the first embodiment of the first muffler 62. An muffler 262 without internal, sealed chambers is easier to manufacture, and thus is a more cost efficient design than the first embodiment. In addition, there is no need to provide a tuning tube between the chambers in the muffler 262 because the concave plate 254 defines channel 269 thereunder.

The elimination of the need for a transfer tube between the chambers in the muffler 262 also provides at least one additional benefit. In mufflers that include a transfer tube (e.g., transfer tube 95 in FIG. 4), when the watercraft 10 becomes inverted, the water in the chamber within the muffler has a tendency to splash around. This may cause water to travel from one chamber to another and, thus, to travel to the engine 50. With the muffler 262, however, splashing is eliminated or at least greatly reduced, thereby eliminating or at least minimizing water travel to other parts of the exhaust system.

Transfer pipe 270 is bent generally into a U-shape with portions extending upwards from their respective points of connection to each muffler 262, 266 and over the driveshaft to a maximum height at an intermediate portion 272 of the transfer pipe 270. In the second embodiment, the respective connection points of the transfer pipe 270 and the exhaust pipe 276 to the second muffler 266 are interposed. That is, in the second embodiment, the transfer pipe 270 is connected to the second muffler 266 behind the connection point of the exhaust pipe 276. As illustrated in FIG. 8, the connection points for the first muffler 262 are altered similarly in this design.

The internal structure of the second muffler 266 of the present embodiment is shown in FIGS. 13–16, and is similar to that of the first muffler 262. The second muffler 266 includes an insertion member 324 to which is connected the transfer pipe 270. The insertion member 324 extends within the muffler 266 to approximately the central axis 332 thereof. Exhaust gases and water enter the second muffler 266 via the insertion member 324. As with the first muffler, a concave plate 354 is fixedly connected to the interior wall of the device 266 to reinforce the second muffler and protect the outer wall thereof from the high heat of the exhaust gases, where the exhaust gases directly impinge against the concave plate 354 rather than the outer wall of the muffler. The concave plate 354 is preferably welded or brazed to the outer wall 327 of the muffler 266 in such a manner to form a substantially liquid-tight seal therebetween. The forward end 359 of the concave plate is connected to the bottom edge 361 of the transverse wall 356. The second muffler 266 further includes a second transverse wall 390 disposed between the transverse wall 356 and the outlet (defined by the extension member 384) of the second muffler. The second transverse wall 390 is fixedly connected to the outer wall of the muffler 266 to form an internal chamber 392 at the forward most end thereof.

Figure 14:
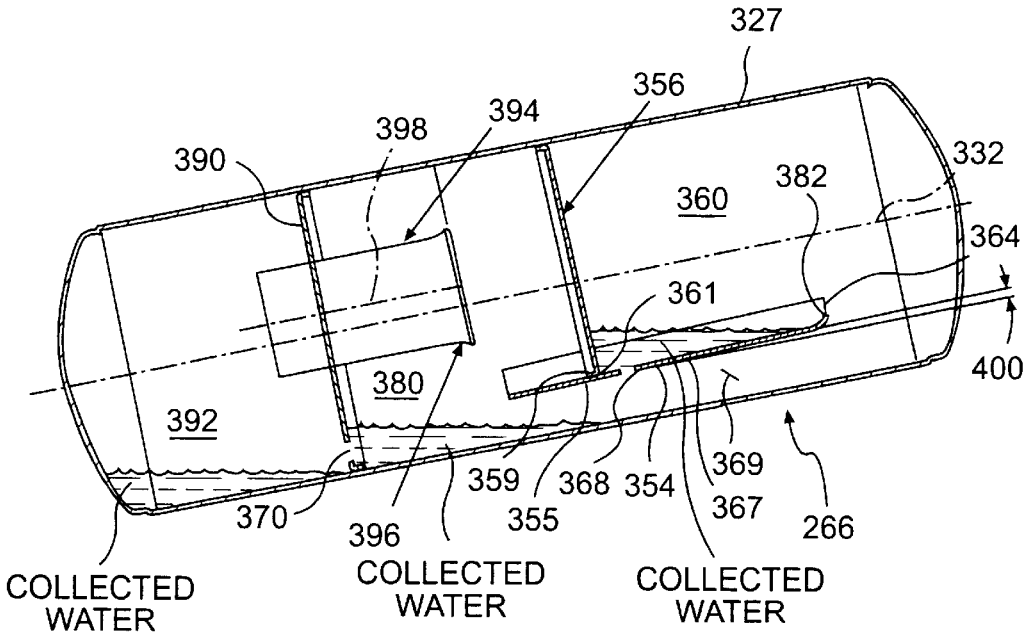
FIG. 14 is a side view of the second muffler of FIG. 13.
Figure 15:
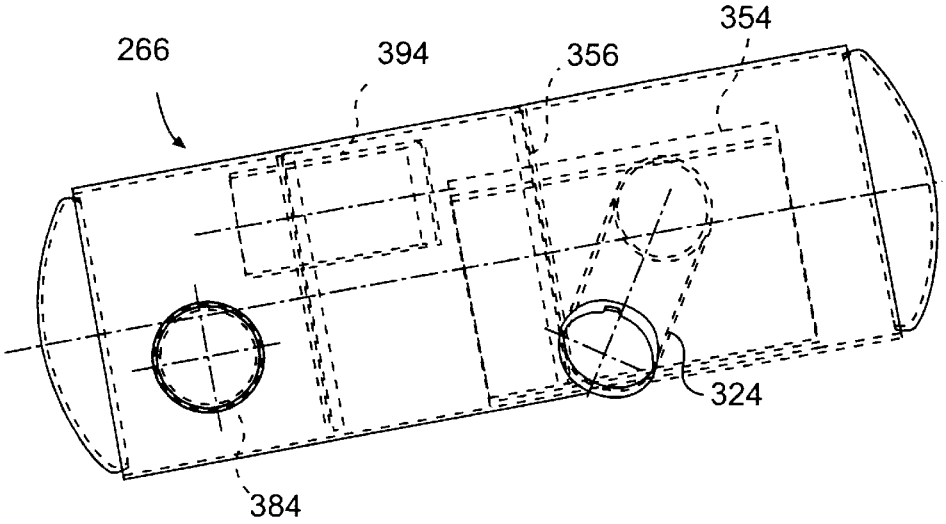
FIG. 15 is a top side view of the second muffler of FIG. 13.

The aft region of the second muffler, which is generally bounded by the transverse wall 356, concave plate 354, and inner surface of the second muffler 266 forms a third water collection region 360. Hence, the transverse wall 256 is also preferably welded or brazed to the outer wall 327 in such a manner to form a liquid tight seal therebetween. Since the second muffler 266 is tilted upwards from the horizontal by an angle beta (which could be the same angle as alpha or could differ therefrom), as water enters the device 266 via the transfer pipe 270 and insertion member 324, it collects in this third water collection region 360. As seen in FIG. 14, collected water is illustrated in the third water collection region 360. As this region fills up, it spills over the free end 364 of the concave plate 354, flows through the channel 369 formed between the underside 367 of the concave plate 354 and the inner surface of the second muffler, and collects in a fourth water collection region 380. The fourth water collection region 380 is generally the space defined by the space forward of the transverse wall 356 and bounded by the muffler 266 outer wall and a second transverse wall 390.

Figure 16:
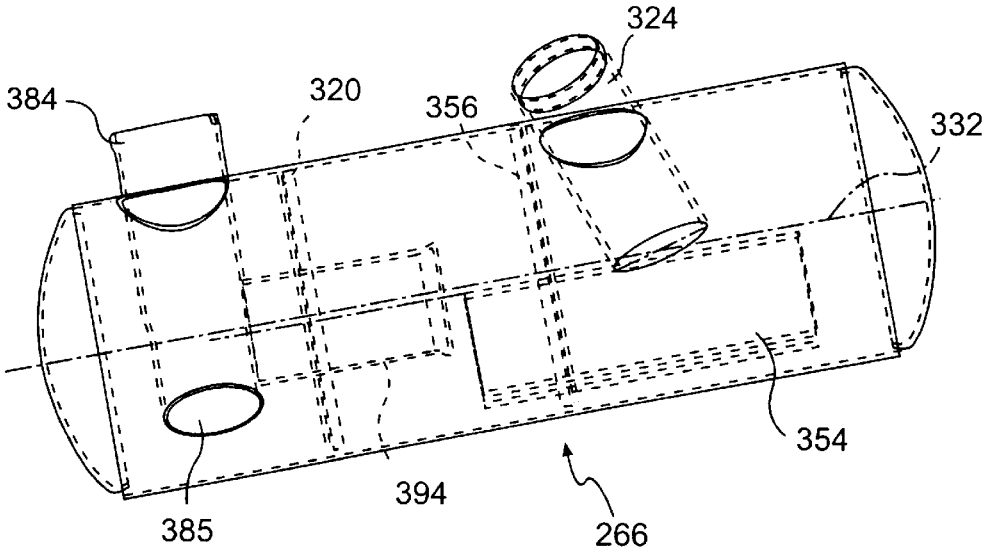
FIG. 16 is another side view of the second muffler of FIG. 13.

Exhaust gases and water are delivered to the internal chamber 392 via a tuning pipe 394. The tuning pipe 394 includes a megaphone inlet end 396 that is disposed between transverse wall 356 and second transverse wall 390. The tuning pipe 394 is positioned such that its central axis 398 is higher than the central axis 332 of the second muffler 266. Exhaust gases and water exit the second muffler 266 via the outlet pipe 276 which is connected to the extension member 384. The inlet 385 of the extension member 384 is disposed beneath the central axis 332 of the expansion device 266 within the internal chamber 392, as seen in FIG. 16. The extension member 384 is designed to be long enough to be able to discharge water into internal chamber 392, but the inlet 385 does not extend so far into the internal chamber 392 to impede exhaust flow therethrough. In particular, the extension member 384 does not extend so far into the water collecting in the internal chamber 392 to establish a back pressure that might impede the flow of exhaust gases through the muffler 266.

The concave plate 354 includes a small through-hole 368 located proximate the transverse wall 356 on the aft side thereof. This through-hole 368 permits collected water in the third water collection region 360 to escape into the fourth water collection region 380, thus controlling the amount of water that collects in the second water collection region 360. That is, as the water collected in the second water collection region 360 increases and the water pressure increases, the amount of water that escapes increases. Though not intended to be limiting, the through-hole 368 may be approximately 10 millimeters (0.39 inches) in diameter. A second through-hole 370 is likewise formed in the transverse wall 390 proximate the outer wall of the muffler 266, which allows collected water in the fourth water collection region 380 to escape into the internal chamber 392. That is, the through-hole 370 regulates that amount of water collected in the fourth water collection region 380 in the same manner as through-holes 368 and 268, described above.

The aft end 364 of the concave plate 354 includes an upwardly curved portion or lip 382, which helps to cool the outer wall of the expansion device 266 by providing a more consistent dripping of the water from the concave plate 354. The line of contact between the concave plate 354 and the interior wall of the muffler 266 is tilted slightly upward with respect to the central axis 332 by an angular-amount given by reference numeral 400. Though not intended to be limiting, the angular amount 400 may be approximately one degree relative to the axis 332 of the muffler 262. As with the concave plate 254, the concave plate 354 is disposed at the angle 400 to establish a megaphone within the muffler 266. The megaphone creates a sound pressure that is lower at the end of the channel 369 nearest to the transverse wall 356 than the end of the channel 369 closest to the free end 364.

During normal operation of the watercraft, cooling water from the exhaust cooling jacket will enter second muffler 266 from the first muffler 262 by way of two mechanisms described above. After the third water collection region 360 fills up, water will then begin collecting in the fourth water collection region 380. Water will find its way to the internal chamber 392 by way of at least three mechanisms. First, the water evaporates and is transferred to the internal chamber 392 along with exhaust gases. Second, as the water collects in the fourth water collection region 380 and enters the internal chamber 392 by way of the through-hole 370. Third, when the collected water in the fourth water collection region 380 rises higher than the inlet 396 of the tuning tube 394, it may flow through tube 394 and into the internal chamber 392. Additionally, if the water level in the fourth water collection region 380 cuts off the exhaust gas flow through the channel 369, the pressure builds up until it pushes the water through the tuning tube 394 in a burst. When the water level within the internal chamber 392 rises higher than the intake 385 of the extension member 384 and cuts off the exhaust gas flow, the pressure again builds up in the expansion chamber 266 until it pushes the water out in a burst, and the water exits via the extension member 384 and the exhaust pipe 276. Also, before such a burst, water evaporates and exits the muffler 266 along with the exhaust gases.

It can also be appreciated that the transfer of water from the first expansion chamber to the second expansion chamber, and then from the second expansion chamber to the atmosphere, by way of the pressure build up which pushes in a burst also takes place in the first embodiments of the mufflers.

It can further be appreciated that, although the mufflers 262, 266 are shown and described with their aft end being raised higher than their forward ends with respect to the hull of the watercraft, the opposite disposition thereof is also contemplated. That is, the forward ends could be raised higher than the aft ends. In such a case, the components of each muffler would be transposed from that shown in FIGS. 12 and 14. That is, the inlets would be forward of the outlets, the concave plates would extend from the first transverse walls toward the forward ends of the mufflers, and the first and second water collection regions would be toward the forward end and aft ends, respectively, of the mufflers.

It can be appreciated that the first and second muffler 262, 266 are effectively water cooled by the above described manner that is controlled by the internal structure of each muffler. That is, the continuous process of collecting entrant water from the cooling jacket 244 into the water collection regions of the first and second mufflers (i.e., the first, second, third, and fourth water collection regions and the internal chamber) and ultimately blowing the collected water to the outside environment cools both mufflers 262, 266. It can also be appreciated that the expansion of the exhaust gases within each muffler 262, 266 attenuates engine sound, as with the first embodiments of the mufflers 62, 66.

Further, as with the first embodiment of the exhaust system 40, it can be appreciated that the configuration of the second embodiment of the exhaust system also effectively inhibits water that has entered the exhaust system at the exhaust end 80 of the exhaust pipe 276 from flowing entirely through the exhaust system and into the engine, even when the watercraft has capsized. Even where water has not entered the exhaust system at the exhaust end 80, the exhaust system effectively inhibits the cooling water that is directed to the first muffler 262 via the cooling water jacket from moving up the goose-neck pipe 220, through the pipe 54, and into the engine 50.

Because the goose-neck pipe 220 enters the expansion chamber 262 from a top side thereof, and proceeds upwards to a maximum height at intermediate location 221, there are only two ways that water can move from the first muffler 262 to the engine 50. First, with sufficient water capacity in the first muffler 262, the user must again capsize the watercraft 10 so that water moves under the force of gravity into the goose-neck pipe 220. When the user then re-uprights the craft, water that is on the forward side of the intermediate location 221 (i.e., the crest of the hump) may flow from the goose-neck pipe into the manifold pipe 54. Then the user must also pitch the watercraft 10 in fore and aft directions in order to move the water within the manifold pipe 54 to the engine. Second, if both the first and second mufflers 262, 266 are completely filled with water, in order for water to move up the goose-neck pipe 220 without the watercraft 10 having been capsized, there must exist enough water pressure to force the water up the insertion member 242 and into the gooseneck pipe 220. This can only occur if the intermediate location 221 of the goose-neck pipe 220 ends up close to or below the waterline of the body of water that the watercraft 10 is in. This may occur, for example, if the user completely submerges at least the aft end of the watercraft, which is an extremely rare occurrence.

It is noted that water will move from one muffler to other only when the water volume in either muffler 262, 266 creates a water level that is greater than the height of the inlet (e.g., inlet 385) of muffler 262, 266 when inverted. In such an instance, when the watercraft 10 becomes inverted, the water may flow through the inlet (e.g., inlet 385) and into a tube or muffler closer to the engine 50.

As can be readily appreciated, the exhaust system designed in accordance with the present invention makes it very difficult for a user to cause water to flow through the exhaust system and into the engine 50. More specifically, the exhaust system is designed so that only a very specific set of watercraft movements will allow the water to flow therethrough and into the engine 50. This greatly minimizes the chances of such an occurrence and thus minimizes the chances of engine damage resulting from such an occurrence.

As mentioned above, the goose-neck pipe 220 is connected to the manifold pipe 54 using a connecting mechanism 230, which may also be referred to as an exhaust coupler 230. FIG. 17 shows one embodiment of the exhaust coupler 230. The manifold pipe 54 includes, as described earlier, an inner wall 412 and an outer wall 414 in spaced apart relation, the space therebetween forming the cooling water jacket 247. The cooling water jacket 247 of the manifold pipe 54 and the cooling water jacket 246 of the goose-neck pipe 220 are connected by at least one flexible tube 426 that is mounted to suitable fittings 428, 430, respectively, that attach to receiving portions 432, 434, respectively. Cooling water is thus transferred from the manifold pipe 54 to the goose-neck pipe 220 via the flexible tube 426, and the cooling water flows from the goose-neck pipe 220 into the first muffler 262, describe above. Preferably, at least two flexible tubes 426 are used on opposite sides of the manifold pipe 54 for transferring the cooling water to the goose-neck pipe 220.

The exhaust coupler 230 includes stepped portions of reduced diameters formed at the end of the manifold pipe 54, namely stepped portions 416 and 418, with stepped portion 418 having a diameter intermediate stepped portion 416 and the inner diameter of the manifold pipe 54 (i.e., the inner wall 412). Stepped portion 418 is herein after referred to as flange portion 418. Specifically, the flange portion 418 extends from the end of the manifold pipe 54 outward and is telescopically disposed within the goose-neck pipe 220 by an amount such that the end of the goose-neck pipe 220 and the end of the manifold pipe 54 are in spaced apart relation, forming a space between the ends thereof, generally indicated by reference numeral 460. The end of the goose-neck pipe 220 includes the end 438 of the inner wall 244 and the end 446 of the water jacket. The end of the manifold pipe 54 includes a vertical wall portion 417, which transitions stepped portion 416 to flange portion 418, and vertical wall portion 415, which transitions the outer surface of the manifold pipe 54 to the stepped portion 416. A radially-extending protruding member 420 is attached to the flange portion 418 at a location that is telescopically disposed within the goose-neck pipe 220. Therefore, the space 460 includes the space between the inner wall 244 and the outer surface 419 of the flange portion 418.

Figure 18:
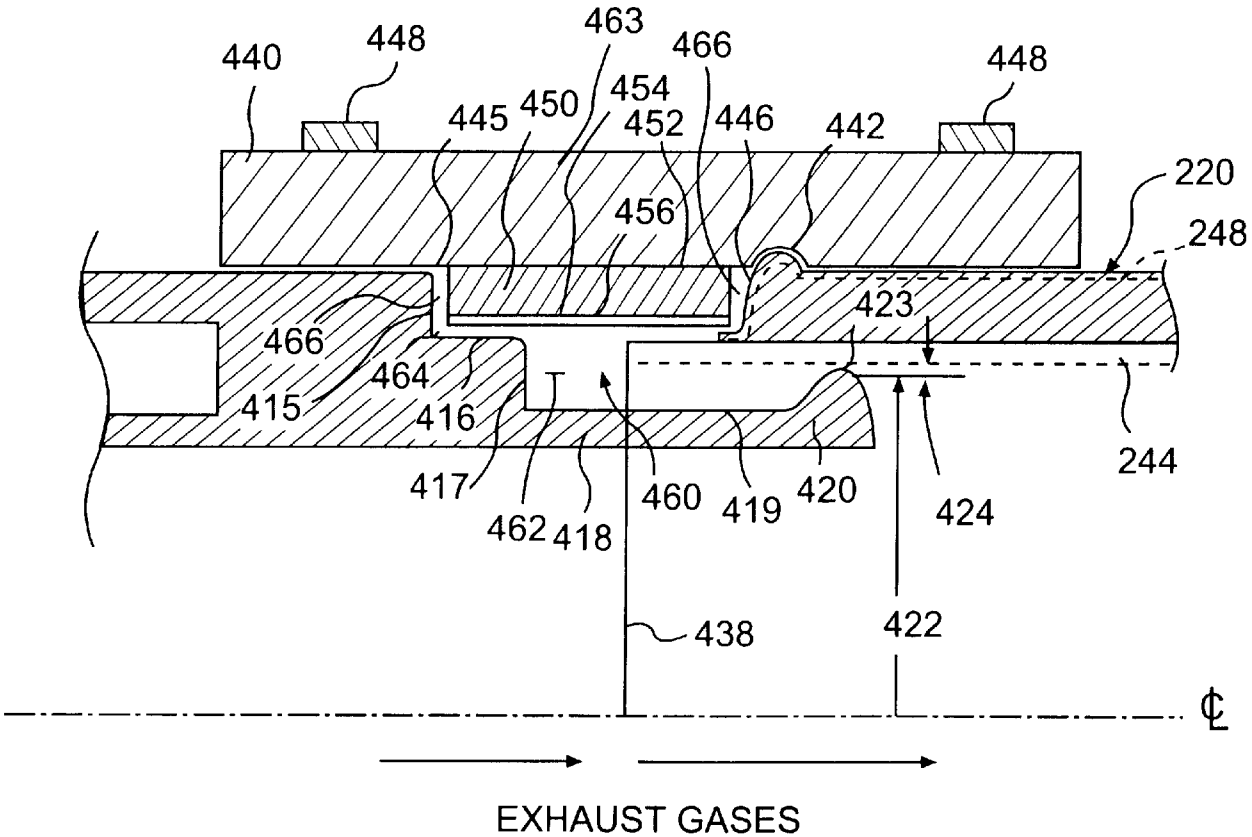
FIG. 18 is a blown up view of the exhaust coupler of FIG. 17.
Figure 19:
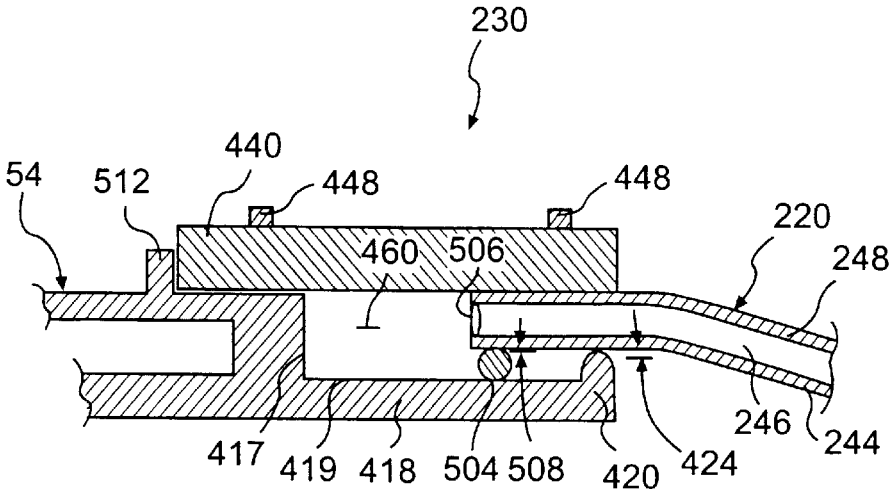
FIG. 19 is a second embodiment of the exhaust coupler according to the principles of the present invention.

As shown in FIG. 18, the protruding member 420 may be disposed at the distal end of the flange portion 418, and the outer surface 423 may have a curved cross-section. Preferably, the protruding member 420 is integrally formed with the flange portion 418. The outer diameter 422 of the protruding member 420 is made to be less than the inside diameter of inner wall 244 of the goose-neck pipe 220 so that a small gap 424 exists therebetween. The gap 424 may vary in dimension, but is preferably about 0.5 millimeters (0.0197 inches). Preferably, the small gap 424 is made as small as possible without impeding rotational movement of the goose-neck pipe 220 with respect to the manifold 54. Because of the gap 424 and the decreased diametric dimension of the surface 419 of the flange portion 418 (i.e., its outer diameter), the goose-neck pipe 220 and the exhaust manifold 54 are able to move relative to each other while maintaining fluid connection. When the goose-neck pipe 220 and the manifold pipe 54 move relative to each other, the outer surface 423 of the protruding member 420 partially engages the inner wall 244 of the goose-neck pipe. That is, a portion of the circumferential surface of the protruding portion 420 will be in contact with the inner wall 244. Because of this partial contact between the outer surface 423 of the protruding member and the inner wall 244, the protruding member 420 inhibits, but does not entirely prevent, exhaust gases from entering the air space 460. The end of the manifold pipe 54 is preferably machined to its final shape.

A flexible sleeve 440 is fitted over the outside of both the manifold pipe 54 and the goose-neck pipe 220 and clamped into place with clamps 448. The flexible sleeve 440 covers the space 460, with a portion of the inner surface 445 thereof being exposed to the space 460. The flexible sleeve is preferably made of rubber, but any other suitable flexible material could also be used. The flexible sleeve 440 combined with the telescopically disposed flange portion 418, which has a radially protruding member 420 having an outer diameter slightly less that the inner diameter of the outer wall 244 of the goose-neck pipe 220, provides a flexible connection between the manifold pipe 54 and the goose-neck pipe 220. For example, because there is no fixed contact between the protruding end portion 420 and the goose-neck pipe 220, and because there is ample space between the outer diameter 419 of the stepped portion 418 and the inner wall 244, the ends of each of the manifold pipe 54 and goose-neck pipe 220 are allowed to move relative to each other while maintaining fluid connection. Specifically, the goose-neck pipe 220 is allowed to swivel about the protruding member 420 of stepped portion 418.

The flexible sleeve 440 may include an indentation 442 that accommodates a protrusion 444 in the outer wall 248 of the goose-neck pipe 220 at its end, the protrusion 444 formed by an inward bend of the outer wall 248 to the inner wall 244, and welding the outer wall thereto to form the end wall 446 of the cooling water jacket. The protrusion 444 and corresponding indentation 442, along with clamps 448, help fix the axial position of the goose-neck pipe 220 with respect to the manifold pipe 54.

Preferably, however, there is no indentation provided in the flexible sleeve 440. Instead, in the preferred embodiment, the flexible sleeve 440 has a smooth interior surface that is deformed (along with other portions) to create an indentation 442 as the protrusion 444 compresses the flexible sleeve 440.

An insulating material 450 is provided in the annular space between the end wall 446 of the goose-neck pipe 220 and the vertical wall 415 from the outside diameter of the manifold pipe 54 and the stepped portion 416. This insulating material 450 is made of a fibrous material having high heat resistance capabilities. Preferably, the insulating material 450 is made of a densely packed, fiberglass cloth. The outer surface 452 (i.e., outside diameter) of the insulating material 450 engages a portion of the inner surface 445 of the flexible sleeve 440. Preferably, the outer surface 452 of the insulating material 450 and the inner diameter of the flexible sleeve 440 are in direct contact. However, another thin layer (not shown) of heat resistant material may be interposed therebetween. The insulating material 450 may include a reflective layer 454 attached to the inner surface 456 (i.e., inner diameter) thereof. Preferably, the reflective layer 454 includes metal foil. The insulating material 450 is positioned such that a space is present between each end thereof and the vertical wall 415 and end wall 446. Further, the thickness of the insulation material 450 combined with the reflective layer 454 is such that the inside diameter, as measured from the inside surface of the reflective layer, is greater than the diameter of the stepped portion 416 and inner wall 244 of the goose-neck pipe 220 so that the reflective layer 454 is not in mechanical contact with either.

The insulating material 450 is thus disposed such that the air space 460 is formed around the insulating material 450 except for its outer surface 452, which is in contact with the inner surface of the flexible sleeve 440. This air space 460 is T-shaped and includes a main central portion 462 that transitions into a left and right sides of a horizontal portions 464, each left and right side proceeding to side portions 466 on either side of the insulating material. These side portions 466 are radially bounded by the flexible sleeve main central portion 463. The main central portion 462 includes the air space between the inner wall 244 of the goose-neck pipe 220 and the stepped portion 418 disposed interior of the goose-neck pipe 220.

During operation of the watercraft 10, the air within air space 460 becomes very hot and turbulent because exhaust gases leak through the gap 424. The insulating material 450 presents a sufficient thickness that exhaust gases passing therethrough will have cooled sufficiently so as not to damage (or burn through) the flexible sleeve 440. The insulating material 450 thus shields the flexible sleeve 440 from this hot, turbulent air so that the flexible sleeve 440 does not overheat. If the flexible sleeve 440 overheats, it may deform or in a worse case scenario, if made of rubber, melt through. The reflective layer 454 provides at least two functions. First, it covers and protects the insulating material from the turbulent air within the air space 460. This prevents wear of the insulation material 450 caused from direct contact with hot, turbulent air. Second, the reflective layer 454 reflects radiant energy emanating from the surrounding hot material, and specifically, the outer surface 419 of the flange portion 418, toward the flexible sleeve 440, thus further protecting the flexible sleeve from overheating.

The exhaust coupling 230 therefore provides a flexible connection between the manifold pipe 54 and the goose-neck pipe 220. Such a flexible connection prevents engine vibration from being transmitted to the goose-neck pipe 220 and thus the remainder of the exhaust system.

It can be appreciated that the exhaust coupler 230 described above and the embodiments below is not limited by the use of the manifold pipe 54 and the goose-neck pipe 220, and the exhaust coupler 230 can be used to establish a flexible connection establishing a fluid communication between any exhaust communication members.

FIGS. 19–27 illustrate various embodiments of the connecting mechanism 230, wherein the same reference numerals are used where applicable. The embodiment shown in FIG. 19 includes the stepped portion 418 telescopically disposed within the goose-neck pipe 220. The stepped portion 418 includes a protruding end portion 420 having an outside diameter slightly smaller than the inside diameter of inner wall 244 of the goose-neck pipe 220, thereby forming the gap 424 therebetween. Gap 424 is of the same dimension as in the first embodiment of the connecting mechanism. Gap 424 may also be non-existent, i.e., the gap 424 dimension is zero. A chord 504 is disposed between the outer surface 419 of stepped portion 418 and the inner wall 244 near the end 506 of the goose-neck pipe 220. Chord 504 may have a circular cross section, and it is sized such that a small gap 508 may exist between it and the inner wall 244. However, the chord 504 may also be tightly fitted against both outer surface 419 and inner wall 244. The chord 504 is heat resistant and thus shields the flexible sleeve 440 from the hot turbulent gases that penetrate gap 424. As with the first embodiment, the flexible sleeve 440, which is preferably made of a rubber material, is clamped with clamps 448 to both the manifold pipe 54 and the goose-neck pipe 220. A protruding stop member 512 formed on the outside surface of the manifold pipe 54 provides an abutment for the flexible sleeve 440, thus helping to secure the flexible sleeve axially. Although not shown in FIG. 19, the insulating material 450 described in the first embodiment may also be used.

Figure 20:
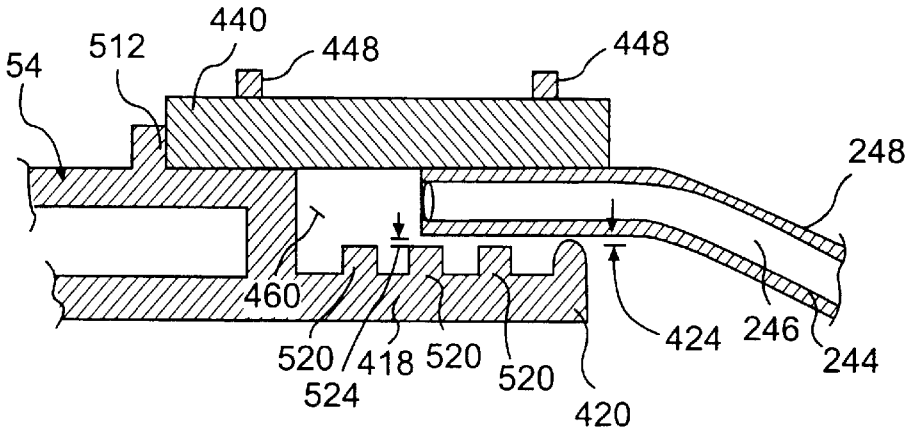
FIG. 20 is a third embodiment of the exhaust coupler according to the principles of the present invention.

FIG. 20 illustrates a third embodiment of the exhaust coupler 230, which is the same as the second embodiment described above except that instead of using chord 508, at least one protruding member 520 is formed in the flange portion 418 intermediate vertical wall 417 and protruding end portion 420. Preferably, the at least one protruding member 520 includes a plurality of protruding members 520. Protruding members 520 act as fins which increase heat dissipation toward the water jacket 246 of the goose-neck pipe 220. A gap 524 exists between the outside diameter of the protruding members 520 and the inner wall 244 of the goose-neck pipe. The gap 524 may range from 0 to 0.5 millimeters (0 to 0.02 inches).

Figure 21:
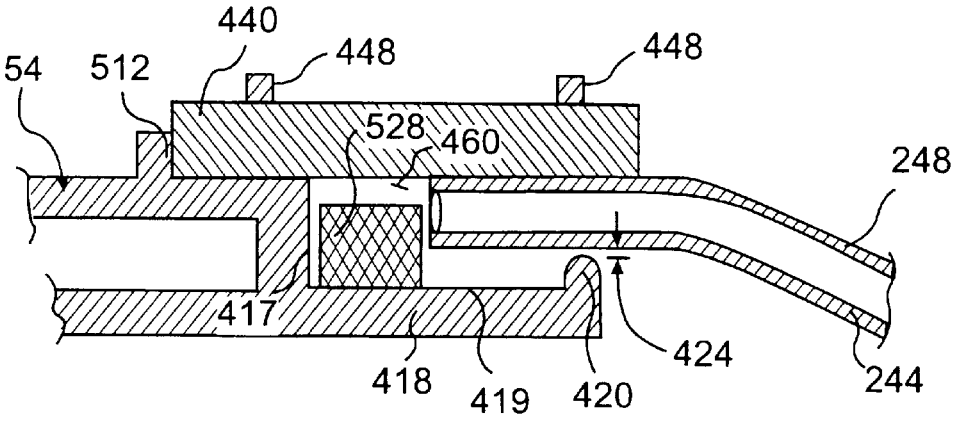
FIG. 21 is a fourth embodiment of the exhaust coupler according to the principles of the present invention.

FIG. 21 illustrates a fourth embodiment of the exhaust coupler 230, with the general structure being the same as the second embodiment. In this embodiment, a metal meshed member 528 is disposed within the air space 460 between the flexible sleeve 440 and the outer surface 419 of the flange portion 418. Preferably, the metal meshed member 528 is disposed toward the outer surface 419 such that an air space is present between the flexible sleeve 440 and the outside diameter of the metal meshed member. The metal meshed member 528 may be either loosely or tightly fitted to the outer surface 419 of the flange portion 418.

The metal meshed member 528 is preferably made of steel wire. More specifically, the metal meshed member 528 includes a stainless steel wire mesh. The metal meshed member 528 acts as a heat shield, thus protecting the flexible sleeve 440 from hot gases within space 460. The high surface area characteristic of the meshed member 528 facilitates heat absorption, thus creating a heat sink away from the flexible sleeve 440. The bulk density of the meshed member 528 may range from 5% to 90%. Preferably, a bulk density of 40% is used.

Figure 22:
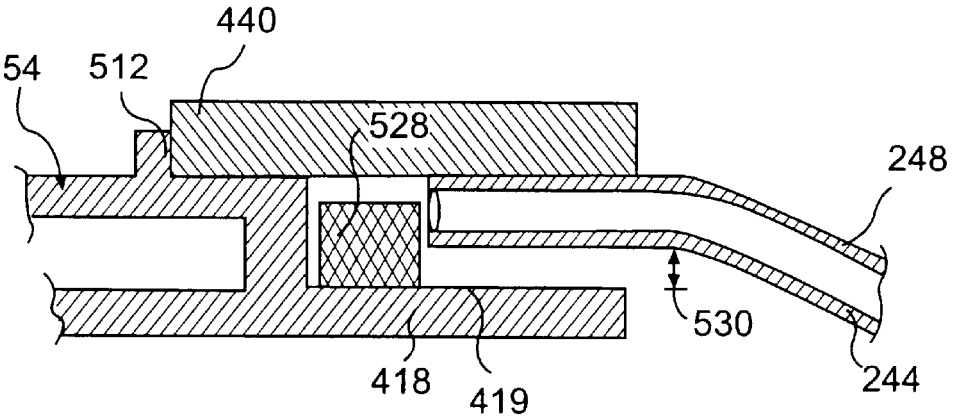
FIG. 22 is a fifth embodiment of the exhaust coupler according to the principles of the present invention.

FIG. 22 illustrates a fifth embodiment of the exhaust coupler 230, which also uses the metal meshed member 528. However, in this embodiment, the flange portion 418 does not include a protruding member at its end. Rather, the outer surface 419 of the flange portion 418 extends the full length thereof. As such, a relatively large distance 530 exists between the outer surface 419 and the inner wall 244. The distance 530 may be in the range of 1.25 to 6.35 millimeters (0.05 to 0.25 inches).

Figure 23:
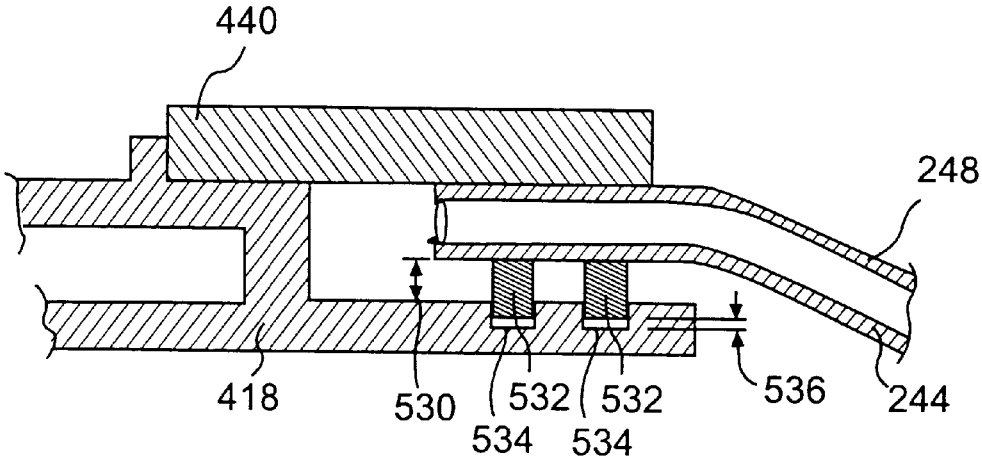
FIG. 23 is a sixth embodiment of the exhaust coupler according to the principles of the present invention.
Figure 24:
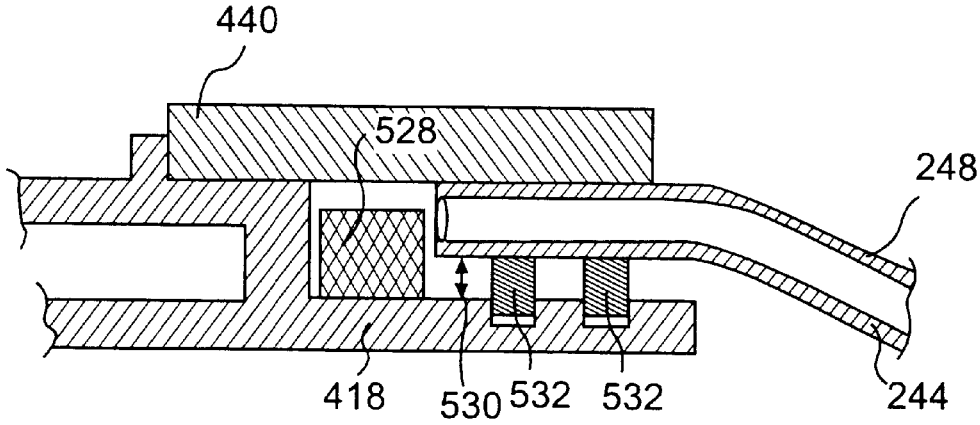
FIG. 24 is the embodiment of FIG. 23 with the addition of a wire meshed element.

FIG. 23 illustrates a sixth embodiment of the exhaust coupler 230 which utilizes at least one ring seal member 532 that is disposed within a seat portion 534 formed within the flange portion 418. The outside diameter of the ring seal member 532 engages the inner wall 244 to seal the air space 460, and thus shield the flexible sleeve 440 from hot gases. A sufficient clearance 536 is kept between the inside diameter of the ring seal member 532 and the diameter of the seat portion 534 to allow radial displacement of the ring seal member, thus enhancing the flexibility of the connection between the tubular metal pipe 40 and the goose-neck pipe 220. In this embodiment, the flange portion 418 also need not include a protruding end portion. The at least one ring seal member 532 may include a plurality of ring seal members 532. The meshed element 528 may also be used with this embodiment, as shown in FIG. 24.

Figure 25:
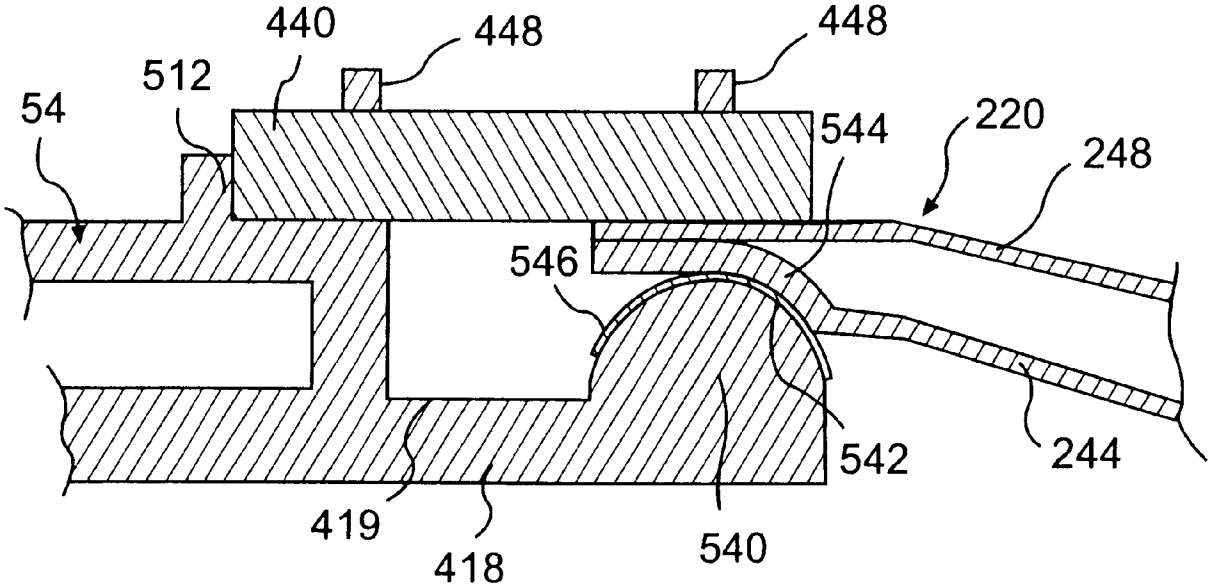
FIG. 25 is a seventh embodiment of the exhaust coupler according to the principles of the present invention.

FIG. 25 illustrates a seventh embodiment of the exhaust coupler 230. In this embodiment, the flange portion 418 includes a raised portion 540 formed at an end thereof. The raised portion 540 preferably has a semi-circular cross-section. A portion of the outer surface 542 of the raised portion 540 provides pivotal support for the end of the goose-neck pipe 220. The end of the goose-neck pipe 220 includes the inner wall 244 being depressed and crimped to the outer wall 248, and a portion 544 of the inner wall 244 is curved to correspond to the outer surface 542 of the raised portion 540. As seen in FIG. 25, because the inner wall 244 is depressed and crimped to the outer wall 248, the interface of the raised portion 540 and the curved portion 544 of the inner wall 244 is located at a greater radial distance from the centerline than the radial location of the inner wall 244 of the previous embodiments. The outer surface 544 may include a layer 546 of material to provide better contact, and thus a better seal, between the outer surface 542 and the curved portion 544 of the inner wall 244. The layer 546 may include copper, or any other suitable material that is generally softer than both the raised portion 540 and the inner wall 244. Preferably, there is no gap between the outer surface 542 and the curved portion 544.

The features of each embodiment of the exhaust coupler 230 shown in FIGS. 19–25 are not intended to be limited to the respective embodiment shown or described. Rather, each feature of any embodiment may be used in any other embodiment shown. For example, though the embodiment of FIG. 25 is not shown with either a wire meshed element 528 or an insulating material 450, either could be used.

Figure 26:
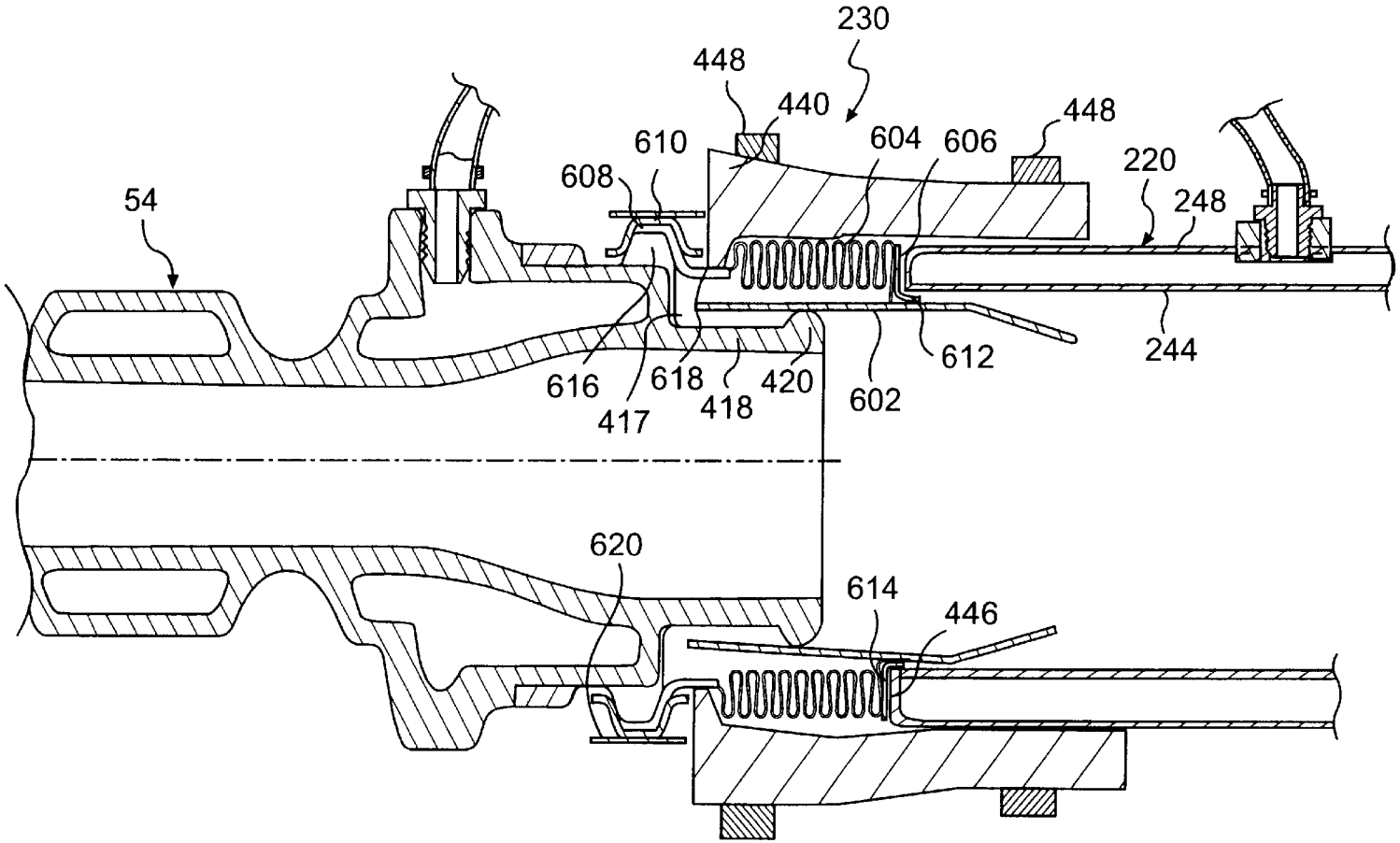
FIG. 26 is a eighth embodiment of the exhaust coupler according to the principles of the present invention.

FIG. 26 illustrates an eighth embodiment of the exhaust coupler 230, wherein the same reference numerals are used when appropriate. The end of the manifold pipe 54 includes the flange portion 418 with the protruding member 420 formed on an end thereof. The flange portion 418 is telescopically disposed within a tubular insert 602, which in turn extends axially to be telescopically disposed within the goose-neck pipe 220. Disposed between the tubular insert 602 and the flexible sleeve 440 is, among other things, a bellows 604, and end support 606, and a V-band clamp 608. The aft end of the bellows 604 is fixedly attached, preferably by spot welding, to the end support 606. The end support 606 may have an L-shaped cross section, with the end of the bellows being spot welded to the horizontal leg 612 thereof, and the last "coil" of the bellows engaged with the vertical portion 614 of the end support 606. The leg 612 of the end support 606 is engaged with the upper surface of the tubular insert 602, and the end 446 of the goose-neck pipe 220 abuts the vertical portion 614. The manifold pipe 54 has formed therein a V-shape protrusion 616 extending radially outward for engagement with the correspondingly shaped V-band clamp 608. The V-band clamp 608 includes a tab portion 618 that extends axially substantially parallel the flange portion 418, and ends at a location intermediate the vertical wall 417 and the protruding portion 420. The bellows 604 extends from the end support 606 to the tab portion 618 of the V-band clamp, and is fixedly attached thereto, preferably by spot welding. Nestled atop the V-band clamp 608 is a second V-band clamp 610. The flexible sleeve 440 is fitted over the V-band clamp 610 and the goose-neck pipe 220, covering the bellows 604. A flat hoop 620 may be disposed between the flexible sleeve 440 and the V-band clamp 610 to provide an increased surface area for contact with the flexible sleeve 440.

The bellows 604, which is preferably made of stainless steel, provides a flexible coupling of the manifold pipe 54 and the goose-neck pipe 220, and it also absorbs and dissipates heat. As with the previous embodiments, the flexible sleeve 440 is preferably made of rubber, and is clamped into position with clamps 448. The water jackets of the manifold pipe 54 and the goose-neck pipe 220 are connected as in the first embodiment.

Figure 27:
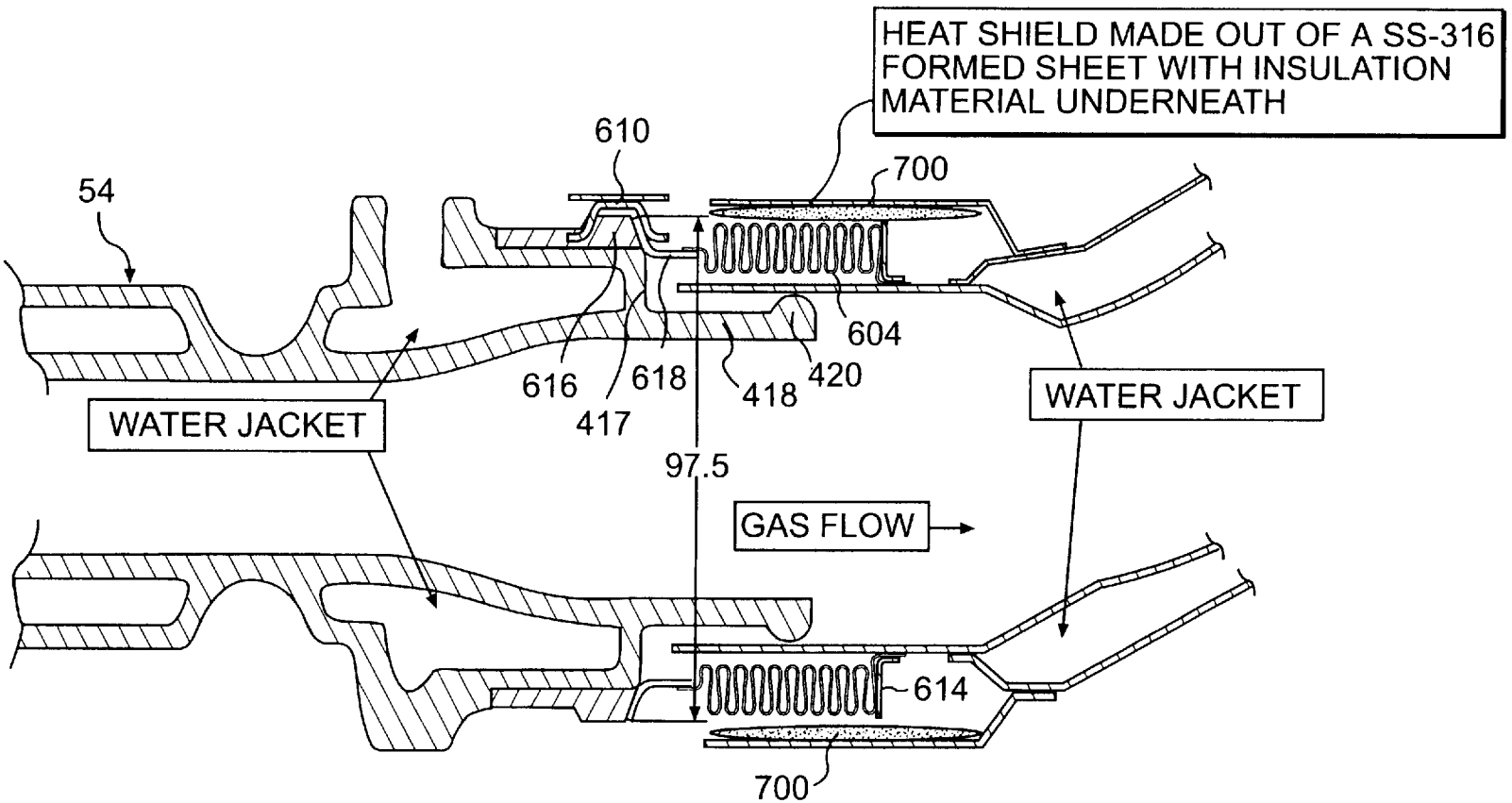
FIG. 27 is a ninth embodiment of the exhaust coupler according to the present invention, this embodiment being a variation of the embodiment depicted in FIG. 26.

In an alternate embodiment of this construction, which is shown in FIG. 27, the bellows 604 is encircled by a heat shield 700.

Vibrations transferred to the hull can significantly add to the overall noise generated by the watercraft 10. Therefore, by reducing the amount of vibrations transferred to the hull, the watercraft 10 can be made to run more quietly. One way that noise is minimized in the watercraft 10 of the present invention is the inclusion of two flexible couplings within the exhaust system. The first flexible coupling is between the gooseneck and the first muffler. The second flexible coupling is between the exhaust manifold and the gooseneck. Both of these flexible couplings minimize the transfer of vibrations from one portion of the exhaust system to another, thereby minimizing the amount of sound generated by the watercraft 10.

While the invention has been described in connection with what is presently considered to be the most practical and preferred embodiments, it is to be understood that the invention is not to be limited to the disclosed embodiments and elements, but, to the contrary, is intended to cover various modifications, equivalent arrangements, and equivalent elements included within the spirit and scope of the appended claims.

What is claimed is:

1. An exhaust coupler connecting first and second exhaust communication members through which exhaust gases flow, the exhaust coupler comprising:

a flange portion extending from an end of the first exhaust communication member, the flange portion being telescopically disposed within the second exhaust communication member, the ends of each of the first and second exhaust communication members being in spaced apart relation to form a space between the ends;

a protruding member attached to the flange portion and disposed within the second exhaust communication member, the protruding member being constructed and arranged to inhibit exhaust gases from entering the space;

a flexible sleeve disposed over an outer surface of both the first and second communication members and axially fixed to each thereto, the flexible sleeve covering the space; and an insulating material disposed within the space.

2. The exhaust coupler of claim 1, wherein the insulating material includes an outer surface engaging with the inner surface of the flexible sleeve to protect the flexible sleeve from hot gases within the space.

3. The exhaust coupler of claim 1, wherein the protruding member is radially extending.

4. The exhaust coupler according to claim 1, wherein the protruding member is integrally formed with the flange portion.

5. The exhaust coupler according to claim 1, wherein the protruding member is disposed at a distal end of the flange portion.

6. The exhaust coupler according to claim 5, wherein the outer dimension of the protruding member is less than the inner dimension of the second exhaust communication member such that the first and second exhaust communication members move relative to each other about the outer surface of the protruding member to provide a flexible connection therebetween.

7. The exhaust coupler according to claim 1, wherein the insulating material includes a reflective layer attached an inner surface thereof.

8. The exhaust coupler according to claim 7, wherein the reflective layer includes metal foil.

9. The exhaust coupler according to claim 1, wherein the insulating material includes heat resistant, fiberglass cloth.

10. The exhaust coupler according to claim 1, wherein the outer surface of the first connection member includes a protruding portion for abutting engagement with an end of the flexible sleeve to inhibit axial displacement thereof.

11. The exhaust coupler according to claim 1, wherein the flexible sleeve includes rubber.

12. The exhaust coupler according to claim 1, wherein the space is T-shaped.

13. The exhaust coupler according to claim 12, wherein the insulation material is placed in a horizontal portion of the T-shaped space.

14. The exhaust coupler according to claim 13, wherein the insulating material includes a reflective layer attached to an inner surface thereof.

15. The exhaust coupler according to claim 13, wherein the insulating material includes heat resistant, fiberglass cloth.

16. The exhaust coupler according to claim 1, wherein the protruding member is at least one ring seal disposed within a seat portion formed around the flange portion.

17. An exhaust coupler connecting first and second exhaust communication members through which exhaust gases flow, the exhaust coupler comprising:

a flange portion extending from an end of the first exhaust communication member, the flange portion being telescopically disposed within the second exhaust communication member, the ends of each of the first and second exhaust communication members being in spaced apart relation to form a space between the ends;

a protruding member attached to the flange portion and disposed within the second exhaust communication member, the protruding member being constructed and arranged to inhibit exhaust gases from entering the space;

a flexible sleeve disposed over an outer surface of both the first and second communication members and axially fixed to each thereto, the flexible sleeve covering the space, wherein the protruding member is at least one ring seal disposed within a seat portion around the flange portion.

18. An exhaust coupler connecting first and second exhaust communication members through which exhaust gases flow, the exhaust coupler comprising:

a flange portion extending from an end of the first exhaust communication member, the flange portion being telescopically disposed within the second exhaust communication member, the ends of each of the first and second exhaust communication members being in spaced apart relation to form a space between the ends;

a protruding member attached to the flange portion and disposed within the second exhaust communication member, the protruding member being constructed and arranged to inhibit exhaust gases from entering the space, wherein the protruding member is a raised portion integrally formed with the flange portion;

a flexible sleeve disposed over an outer surface of both the first and second communication members and axially fixed to each thereto, the flexible sleeve covering the space, and a layer disposed on at least a portion of a surface of the protruding member.

19. The exhaust coupler of claim 18, wherein the layer is at least one of copper or a material including copper.

20. An exhaust coupler connecting first and second exhaust communication members through which exhaust gases flow, the exhaust coupler comprising:

a flange portion extending from an end of the first exhaust communication member, the flange portion being telescopically disposed within the second exhaust communication member, the ends of each of the first and second exhaust communication members being in spaced apart relation to form a space between the ends;

a protruding member attached to the flange portion and disposed within the second exhaust communication member, the protruding member being constructed and arranged to inhibit exhaust gases from entering the space;

a heat resistant member positioned in the space between the ends; and a flexible sleeve disposed over an outer surface of both the first and second communication members and axially fixed to each thereto, the flexible sleeve covering the space and the heat resistant member shielding the flexible sleeve from exhaust gases.

21. The exhaust coupler of claim 20, wherein the heat resistant member is a chord.

22. An exhaust coupler connecting first and second exhaust communication members through which exhaust gases flow, the exhaust coupler comprising:

a flange portion extending from an end of the first exhaust communication member, the flange portion being telescopically disposed within the second exhaust communication member, the ends of each of the first and second exhaust communication members being in spaced apart relation to form a space between the ends;

a first protruding member attached to the flange portion and disposed within the second exhaust communication member, the protruding member being constructed and arranged to inhibit exhaust gases from entering the space;

at least one second protruding member disposed within the space and forming a fin that dissipates heat within the space; and a flexible sleeve disposed over an outer surface of both the first and second communication members and axially fixed to each thereto, the flexible sleeve covering the space.

23. The exhaust coupler of claim 22, wherein the at least one second protruding member is attached to the flange portion and forms an integral piece with the first protruding member.

24. The exhaust coupler of claim 22, wherein the at least one second protruding member extends from the flange portion towards the second exhaust communication member and is spaced from the second exhaust communication member by a gap.

* * * * *